US011815835B2

(12) United States Patent
Narahara et al.

(10) Patent No.: US 11,815,835 B2
(45) Date of Patent: Nov. 14, 2023

(54) IMAGE FORMING APPARATUS

(71) Applicant: CANON KABUSHIKI KAISHA, Tokyo (JP)

(72) Inventors: Takashi Narahara, Shizuoka (JP); Ryo Morihara, Telok Blangah (SG); Yutaka Sato, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/953,639

(22) Filed: Sep. 27, 2022

(65) Prior Publication Data

US 2023/0102072 A1 Mar. 30, 2023

(30) Foreign Application Priority Data

Sep. 29, 2021 (JP) ..... 2021-159537

(51) Int. Cl.
*G03G 15/20* (2006.01)

(52) U.S. Cl.
CPC ..... *G03G 15/2039* (2013.01); *G03G 2215/00599* (2013.01)

(58) Field of Classification Search
CPC ..... G03G 15/2039; G03G 2215/00599
See application file for complete search history.

(56) References Cited

U.S. PATENT DOCUMENTS

2015/0160593 A1 6/2015 Masumoto et al.
2019/0101854 A1* 4/2019 Taguchi ..... G03G 15/2039

FOREIGN PATENT DOCUMENTS

JP 5900474 B2 4/2016
JP 2020160389 A 10/2020
JP 2021018326 A 2/2021
JP 2021033160 A 3/2021

* cited by examiner

*Primary Examiner* — Stephanie E Bloss
*Assistant Examiner* — Michael A Harrison
(74) *Attorney, Agent, or Firm* — ROSSI, KIMMS & McDOWELL LLP

(57) ABSTRACT

There is used an image forming apparatus including a fixing unit configured to heat a recording material at a fixing nip portion to fix a toner image, and a control unit configured to switch a target temperature, wherein, in the case where the target temperature of preceding recording material is first temperature, the target temperature of subsequent recording material is second temperature which is higher than the first temperature, and a difference between the second temperature and the first temperature has a first value, the control unit performs switching from timing which is earlier than reaching of the second recording material to the fixing nip portion by a predetermined period, and, the higher the target temperature of the preceding recording material, the shorter the predetermined period.

7 Claims, 13 Drawing Sheets

IMAGE FORMING APPARATUS

BACKGROUND OF THE INVENTION

Field of the Invention

The present invention relates to an image forming apparatus.

Description of the Related Art

There is used an image forming apparatus which uses the electrophotographic system such as a laser printer or a digital copier. In such an image forming apparatus, when a toner image is heated and fixed to a recording material, it is possible to reduce power consumption by setting a proper target temperature for each page according to a toner amount on an image which is determined from image data.

Japanese Patent No. 5900474 discloses a technique for achieving both of energy saving and maintenance of print productivity in the case where a target temperature of a subsequent page is higher than that of a preceding page in successive printing. In Japanese Patent No. 5900474, by using information indicating whether or not gloss non-uniformity can occur when the target temperature is increased in the preceding page, in the case where the gloss non-uniformity does not occur, the target temperature is increased in the preceding page and is also increased in a period between sheets, and a desired target temperature is reached when the subsequent page is started.

SUMMARY OF THE INVENTION

In the image forming apparatus described in Japanese Patent No. 5900474, the target temperature is increased in the preceding page in the case where the gloss non-uniformity does not occur but, depending on timing at which the target temperature is increased, there is a possibility that electric power is supplied.

The present invention has been made in view of the above problem, and an object thereof is to control timing at which a target temperature is switched according to target temperatures of a preceding page and a subsequent page.

The present invention provides an image forming apparatus comprising:

a fixing unit configured to heat a recording material on which a toner image based on image data is formed and which is transported at a fixing nip portion to fix the toner image to the recording material; and a control unit configured to determine a target temperature when the fixing unit heats the toner image for each recording material based on the image data, and control switching timing of the target temperature, wherein in a case where the target temperature of a first recording material is a first temperature, the target temperature of a second recording material which is fixed subsequently to the first recording material is a second temperature higher than the first temperature, and, a difference between the second temperature and the first temperature has a first value, the control unit starts switching to the second temperature from timing which is earlier than reaching of the second recording material to the fixing nip portion by a first period, in a case where the target temperature of a third recording material is a third temperature higher than the first temperature, the target temperature of a fourth recording material which is fixed subsequently to the third recording material is a fourth temperature higher than the third temperature, and, a difference between the fourth temperature and the third temperature has the first value, the control unit starts switching to the fourth temperature from timing which is earlier than reaching of the fourth recording material to the fixing nip portion by a second period, and the second period is shorter than the first period.

According to the present invention, it is possible to control the timing at which the target temperature is switched according to the target temperatures of the preceding page and the subsequent page.

Further features of the present invention will become apparent from the following description of exemplary embodiments with reference to the attached drawings.

DESCRIPTION OF THE EMBODIMENTS

Hereinbelow, embodiments of the present invention will be described in detail with reference to the drawings. Note that the dimensions, materials, shapes, and relative arrangements of components described in the embodiments should be appropriately changed according to the configuration of an apparatus to which the invention is applied and various conditions, and the scope of the invention is not intended to be limited to the following embodiments.

Embodiment 1

Image Forming Apparatus

Figure 1:
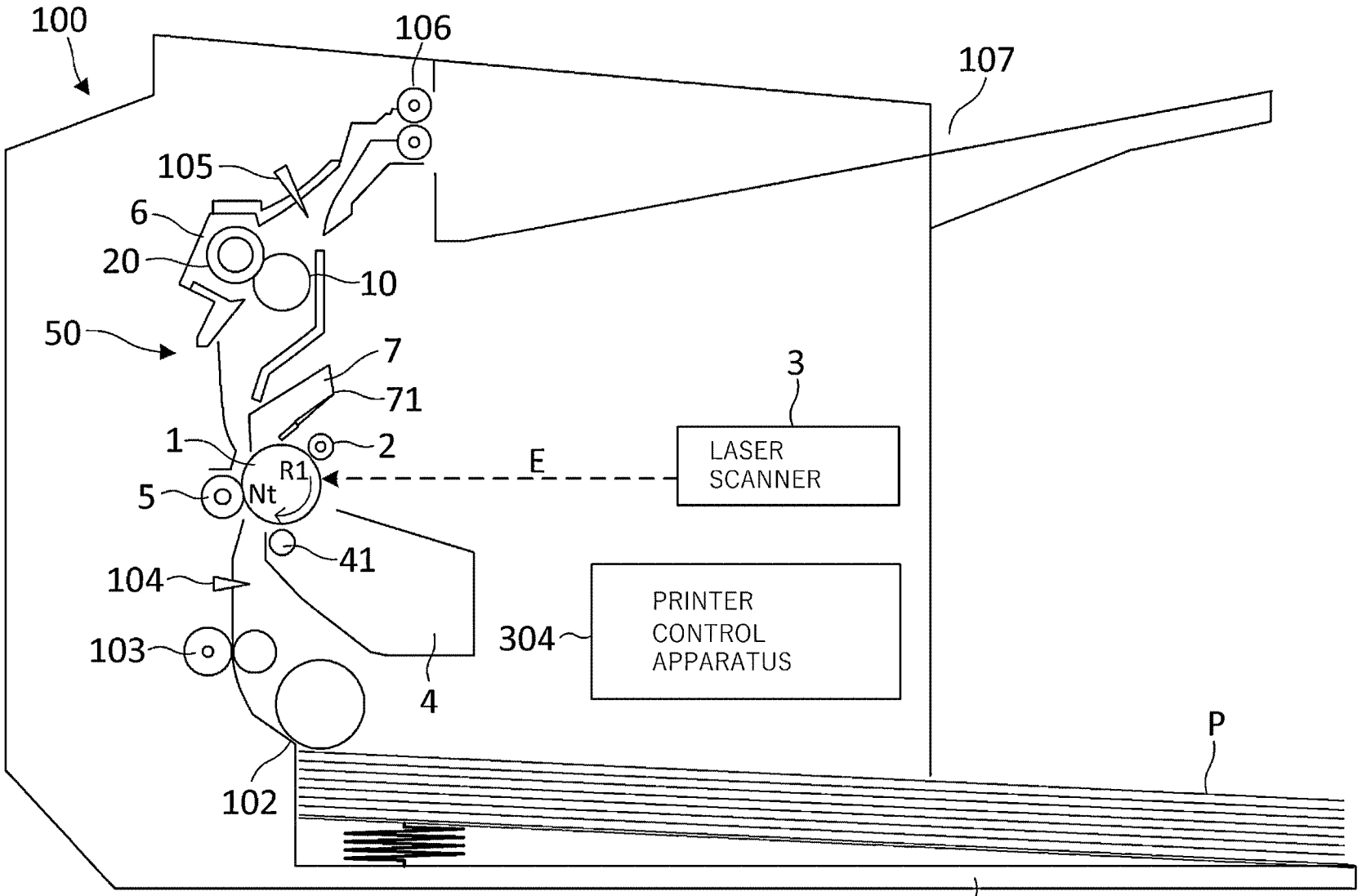
FIG. 1 is a cross-sectional view showing the configuration of an image forming apparatus according to an embodiment.

FIG. 1 shows a schematic cross-sectional view of an image forming apparatus 100 of the present embodiment. Herein, a laser printer is described as an example of the image forming apparatus 100. The present invention can be applied to an image forming apparatus which uses the electrophotographic system or the electrostatic recording system such as a printer other than a laser printer such as an LED printer or a digital copier.

The image forming apparatus 100 generally includes an image forming unit 50 and a printer control apparatus 304. The image forming unit 50 includes a photosensitive drum 1, a charging roller 2, a laser scanner 3, a developing apparatus 4, a transfer roller 5, a heating and fixing apparatus 6 serving as a fixing unit, and a cleaning apparatus 7. The image forming unit 50 forms a toner image corresponding to image data on a recording material P according to control of the printer control apparatus 304 serving as a control unit. In addition, the image forming apparatus includes a paper feed tray 101, a paper feed roller 102, a transport roller 103, a top sensor 104, a paper discharge sensor 105, a paper discharge roller 106, and a paper discharge tray 107.

The photosensitive drum 1 is a drum-shaped electrophotographic photosensitive member, and is constituted by providing a photosensitive material such as an OPC (organic optical semiconductor) or amorphous silicon on a cylindrical drum substrate formed of an aluminum alloy or nickel. The photosensitive drum 1 is rotationally driven at a predetermined process speed (peripheral speed) in a direction of an arrow R1 by drive means (not shown).

The charging roller 2 uniformly charges the surface of the photosensitive drum 1 such that the surface thereof has predetermined polarity and potential. Subsequently, the laser scanner 3 irradiates the photosensitive drum 1 after being charged with a laser beam E, and an electrostatic latent image is thereby formed on the surface of the photosensitive drum. At this point, the laser scanner 3 performs scanning exposure controlled by ON/OFF control performed correspondingly to image data in a longitudinal direction of the photosensitive drum 1, and charges in an exposed portion are thereby removed.

The developing apparatus 4 develops and visualizes the formed electrostatic latent image. As a developing method, in addition to jumping development in the present embodiment, two-component development and contact development are used. Alternatively, image exposure and reversal development may be combined. A developing roller 41 of the developing apparatus 4 causes toner to adhere to the electrostatic latent image on the photosensitive drum 1 to form a toner image.

The toner image on the photosensitive drum 1 is transferred to the surface of the recording material P. The recording material P is fed one sheet by one sheet by the paper feed roller 102 from a state in which the recording material P is stored in the paper feed tray 101, and is fed to a transfer nip portion Nt positioned between the photosensitive drum 1 and the transfer roller 5 via the transport roller 103 and the like.

A tip of the recording material P is detected by the top sensor 104. The printer control apparatus 304 acquires timing at which the tip of the recording material P reaches the transfer nip portion Nt from the position of the top sensor 104, the position of the transfer nip portion Nt, and a transport speed of the recording material P. Subsequently, the transfer roller 5 applies a transfer bias onto the recording material P having been fed and transported at predetermined timing, and the toner image on the photosensitive drum 1 is thereby transferred.

The recording material P to which the toner image has been transferred is transported to the heating and fixing apparatus 6. The heating and fixing apparatus 6 performs heating and pressurization at a fixing nip portion Nf positioned between a film unit 10 and a pressure roller 20 while holding and transporting the recording material P. With this, the toner image is fixed to the surface of the recording material P. Thereafter, the recording material P is discharged onto the paper discharge tray 107 formed on the upper surface of the image forming apparatus 100 by the paper discharge roller 106. Note that the paper discharge sensor 105 detects timing at which the tip and the rear end of the recording material P pass, and the presence or absence of occurrence of a jam or the like is thereby monitored.

On the other hand, the cleaning apparatus 7 removes untransferred toner (residual toner which is not transferred to the recording material P) on the surface of the photosensitive drum 1 after the toner image is transferred with a cleaning blade 71. The removed untransferred toner is used in the next image formation.

The image forming apparatus 100 successively performs image formation by repeating the above operations. The image forming apparatus 100 of the present embodiment can form an image having a resolution of 600 dpi at a speed of thirty-five sheets/min. (LTR vertical feed: a process speed of about 200 mm/s, an inter-sheet distance of 66 mm), and is an apparatus having a lifespan of one hundred thousand sheets.

Printer Control Apparatus

Figure 2A:
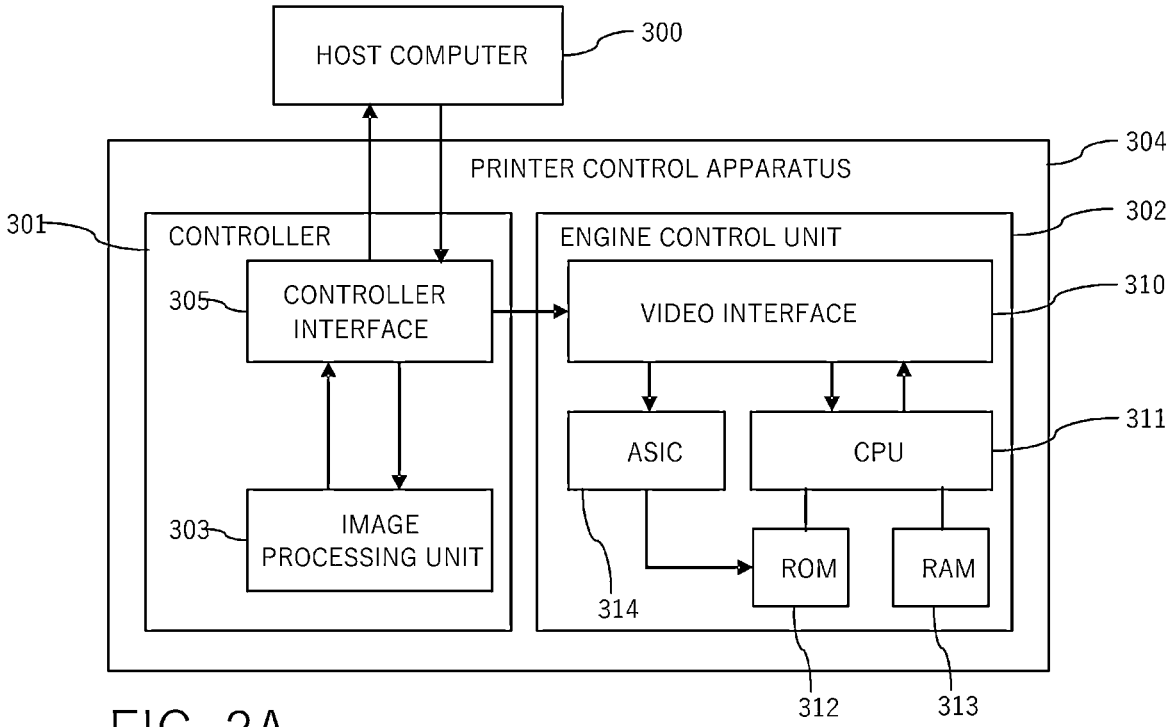
FIGS. 2A and 2B are functional block diagrams related to control of the image forming apparatus according to the embodiment.

The printer control apparatus 304 provided in the image forming apparatus 100 will be described by using FIG. 2A. As shown in FIG. 2A, the printer control apparatus 304 and a host computer 300 constitute a printer system (image forming system).

The host computer 300 is an information processing apparatus having instruction contents from a user and image data serving as the source of an image to be formed. The printer control apparatus 304 controls the image forming apparatus 100 by using information received by performing communication with the host computer 300. The host computer 300 may be a server or a personal computer on a network such as, e.g., the Internet or a local area network (LAN), and may also be a portable information terminal such as a smartphone or a tablet. The printer control apparatus 304 is roughly divided into a controller 301 and an engine control unit 302.

The controller 301 has an image processing unit 303 and a controller interface 305. The controller interface 305 performs communication in and outside the printer control apparatus 304. The image processing unit 303 processes image data received from the host computer 300 via the controller interface 305. Examples of the image data processing include bitmapping of a character code and halftoning of a gray-scale image.

In addition, the controller 301 transmits image data to a video interface 310 of the engine control unit 302 via the controller interface 305. The image data of the present embodiment includes information on a target temperature for maintaining the temperature of a heater 11 which is calculated by the image processing unit 303. A method for calculating the target temperature will be described in detail later.

The engine control unit 302 includes the video interface 310, a central processing unit (CPU) 311, a read only memory (ROM) 312, a random access memory (RAM) 313, and an application specific integrated circuit (ASIC) 314. The controller 301 transmits information on turn-on timing of the laser scanner 3 to the ASIC 314, and transmits a print mode and image size information to the CPU 311. The controller 301 transmits the information on the turn-on timing of the laser scanner 3 to the CPU 311.

The CPU 311 performs various control operations of the engine control unit 302 by using the ROM 312 and the RAM 313 according to a program and a user instruction. The CPU 311 may be a single processor, and may also have a multi-processor configuration. The controller 301 transmits a print command and a cancel instruction to the engine control unit 302 in response to an instruction issued with the host computer 300 by the user to control operations such as start and suspension of a printing operation.

Figure 2B:
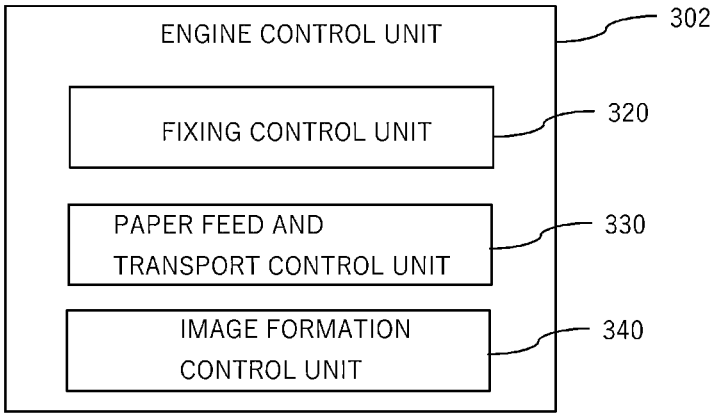

FIG. 2B shows the engine control unit 302 of the present embodiment from the viewpoint of a functional block. The engine control unit 302 has, as functional blocks, a fixing control unit 320, a paper feed and transport control unit 330, and an image formation control unit 340. The CPU 311 performs processing such as storing information in the RAM 313, using a program stored in the ROM 312 or the RAM 313, and referring to information stored in the ROM 312 or the RAM 313 on an as needed basis. With such processing by the CPU 311, the engine control unit 302 functions as individual sections shown in FIG. 2B. The functional blocks may be regarded as program modules executed by the engine control unit 302.

The fixing control unit 320 controls the temperature of the heating and fixing apparatus 6. The paper feed and transport control unit 330 controls operation intervals of the paper feed roller 102. The image formation control unit 340 performs process speed control, development control, charging control, and transfer control. Part or the whole of the processing performed by the image forming apparatus 100 (e.g., processing performed by the engine control unit 302 or the image processing unit 303) may be performed by a processing apparatus such as the host computer 300 or a server (not shown) on a network. In addition, part or the whole of the processing performed by the engine control unit 302 may be performed by the image processing unit 303, and part or the whole of the processing performed by the image processing unit 303 may be performed by the engine control unit 302.

Heating and Fixing Apparatus

Figure 3:
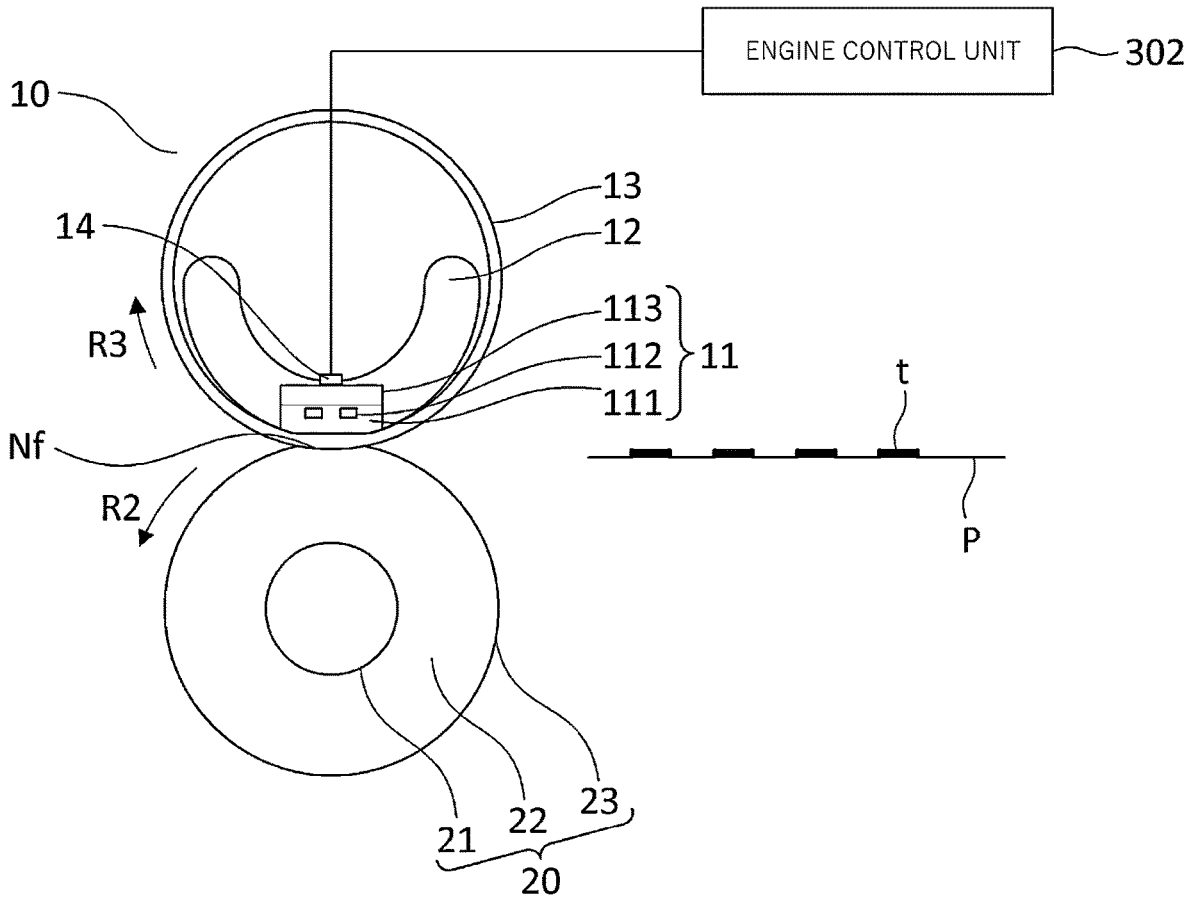
FIG. 3 is a cross-sectional view showing the configuration of a heating and fixing apparatus according to the embodiment.

The heating and fixing apparatus 6 will be described by using FIG. 3. The heating and fixing apparatus 6 of the present embodiment uses a film heating system, and is constituted by a film unit 10 serving as a heating apparatus and the pressure roller 20. The film unit 10 is constituted by a heat-resistant fixing film 13 which is a heating rotating member serving as a heat transfer member, the heater 11 serving as a heating member, and a holder 12 serving as a heater holding member. The heater 11 is provided inside the fixing film 13. The pressure roller 20 is provided so as to face the film unit 10.

The heating and fixing apparatus 6 holds and transports the recording material P on which a toner image t is formed, and the toner image t transported together with the fixing film 13 is thereby fixed to the recording material P at the fixing nip portion Nf formed between the fixing film 13 and the pressure roller 20. Note that, as long as the toner image can be fixed to the recording material, the heating and fixing apparatus 6 is not limited to the configuration of the present embodiment.

On a surface of the heater 11 which is opposite to a side of a surface which slides on the fixing film 13, a thermistor 14 serving as a temperature detection member is disposed so as to be in contact with the surface thereof. The engine control unit 302 controls a current caused to flow to the heater 11 by the fixing control unit 320 such that the temperature of the heater 11 becomes a desired temperature based on the detected temperature of the thermistor 14.

Fixing Film

The fixing film 13 is a composite layer film obtained by coating or tube-covering a surface of a thin metal element tube made of SUS with a releasable layer made of PFA, PTFE, or FEP directly or via a primer layer. Instead of the metal element tube, a base layer obtained by forming a material in which a heat-resistant resin such as a polyimide and a heat conductive filler made of graphite are kneaded into a tubular shape may also be used. In the present embodiment, the fixing film 13 obtained by coating a base-layer polyimide with PFA is used. The fixing film 13 of the present embodiment has a total thickness of 80 μm and an outer peripheral length of 56 mm. The fixing film 13 rotates while sliding on the heater 11 and the holder 12 inside the fixing film 13, and hence it is necessary to suppress frictional resistance between the heater 11 and the holder 12, and the fixing film 13 to a low level. In the present embodiment, by applying a small amount of lubricant such as heat-resistant grease on the surfaces of the heater 11 and the holder 12, it is made possible for the fixing film 13 to rotate smoothly.

Pressure Roller

The pressure roller 20 has a core metal 21, an elastic layer 22, and a releasable layer 23. The elastic layer 22 is formed by foaming heat-resistant rubber such as insulating silicone rubber or fluoro rubber on the core metal 21 made of iron or the like. RTV silicone rubber (not shown) which is subjected to primer processing as an adhesive layer and has adhesion is applied onto the elastic layer 22. Further, the releasable layer 23 is formed on the elastic layer 22 via an adhesive layer. As the releasable layer 23, for example, a layer obtained by covering or coating PFA, PTFE, or FEP with a tube in which a conductive agent such as carbon is dispersed is used.

In the present embodiment, the outer diameter of the pressure roller 20 is 20 mm, and the hardness thereof is 48° (Asker-C 600 g load). The pressure roller 20 is pressurized from both end portions in a longitudinal direction with 147 N (15 kgf) by pressurization means which is not shown. With this, the fixing nip portion Nf required for heating and fixing is formed. In addition, the pressure roller 20 is rotationally driven in a direction of an arrow R2 in FIG. 3 (counterclockwise on the sheet) by rotational drive means which is not shown via the core metal 21 from the end portion in the longitudinal direction. With this, the fixing film 13 is rotated in a direction of an arrow R3 in FIG. 3 (clockwise on the sheet) on the outside of the holder 12.

Heater

The heater 11 is provided inside the fixing film 13. The heater 11 has a board (insulating board) 113 made of alumina or aluminum nitride which is made of ceramic, and a resistance heating layer (heating element) 112 formed on the board 113. The resistance heating layer 112 is covered with a thin overcoat glass 111 for improving insulation and wear resistance, and the overcoat glass 111 is in contact with an inner peripheral surface of the fixing film 13. The overcoat glass 111 is excellent in withstand voltage and wear resistance, and is configured and disposed so as to slide on the fixing film 13.

In the embodiment, the heat conductivity of the overcoat glass 111 is 1.0 W/m·K, the withstand voltage characteristic thereof is not less than 2.5 kV, and the thickness thereof is 70 μm. In addition, in the embodiment, the material of the board 113 is alumina, and its dimensions are a width of 6.0 mm, a length of 260.0 mm, and a thickness of 1.00 mm.

Further, the coefficient of thermal expansion of the board 113 is $7.6\times10^{-6}$/° C. The resistance heating layer 112 of the embodiment is formed of a silver-palladium alloy. The total resistance value of the resistance heating layer 112 is 20Ω, and the temperature dependency of resistibility is 700 ppm/° C.

Holder

The holder 12 is a member which holds the heater 11, and is also a heat-insulating stay holder which prevents heat radiation to the back side of the fixing nip portion Nf. The holder 12 is formed of a liquid crystal polymer, a phenol resin, PPS (poly (phenylene sulfide)), or PEEK (polyether ether ketone). The fixing film 13 is fitted on the holder 12 loosely to some extent, and is disposed rotatably. The material of the holder 12 of the present embodiment is the liquid crystal polymer, the holder 12 has heat resistance of 260° C., and the coefficient of thermal expansion of the holder 12 is $6.4\times10^{-5}$/° C.

Engine Control Section

The engine control unit 302 controls the heater 11 based on the detected temperature of the thermistor 14 according to a control program such that the heater 11 has a predetermined target temperature. For that purpose, the engine control unit 302 controls electric power supplied to the heater 11 such that the heater 11 maintains the target temperature. The engine control unit 302 is an example of a control unit. As a control method, PID control including a proportional term, an integral term, and a differential term is preferable. The following formula (1) represents this control formula.

$$f(t)=\alpha1\times e(t)+\alpha2\times\Sigma e(t)+\alpha3\times(e(t)-e(t-1)) \quad (1)$$

Herein, the individual terms are as follows.

t: control timing f (t): a ratio of heater energization time in a control cycle at control timing (t) (1 or more denotes full turn-on)

e (t): a difference between a target temperature and an actual temperature at current control timing (t)

e (t−1): a difference between the target temperature and the actual temperature at previous control timing (t−1)

α1 to α3: gain constant

α1: P (proportional) term gain

α2: I (integral) term gain

α3: D (differential) term gain

The first term to the third term on the right side in Formula (1) correspond to proportional control, integral control, and differential control in this order. α1 to α3 are proportionality coefficients for weighting an increase or decrease amount of the ratio of energization time of the heater 11 in the control cycle. By setting α1 to α3 according to characteristics of the heating and fixing apparatus 6, proper temperature control is made possible. The engine control unit 302 determines the energization time of the heater 11 in the control cycle according to the value of f (t), and drives a heater energization time control circuit which is not shown to determine output power of the heater 11. Note that, when the D term is not necessary, control may be performed by PI control in which only the P term and the I term function by setting the D term gain to 0. In the embodiment, the control timing is updated at an interval of a control cycle of 100 msec, and the P term gain (α1) is set to 0.05° C.-1, the I term gain is set to 0.01° C.-1 (α2), and the D term gain is set to 0.001° C.-1 (α3). In the present embodiment, a setting is adopted in which the energization time in the control cycle is maximized when the f (t) value is 1, and energization is performed for the maximum energization time in the control cycle in the case where a calculation result is more than 1.

Figure 4:
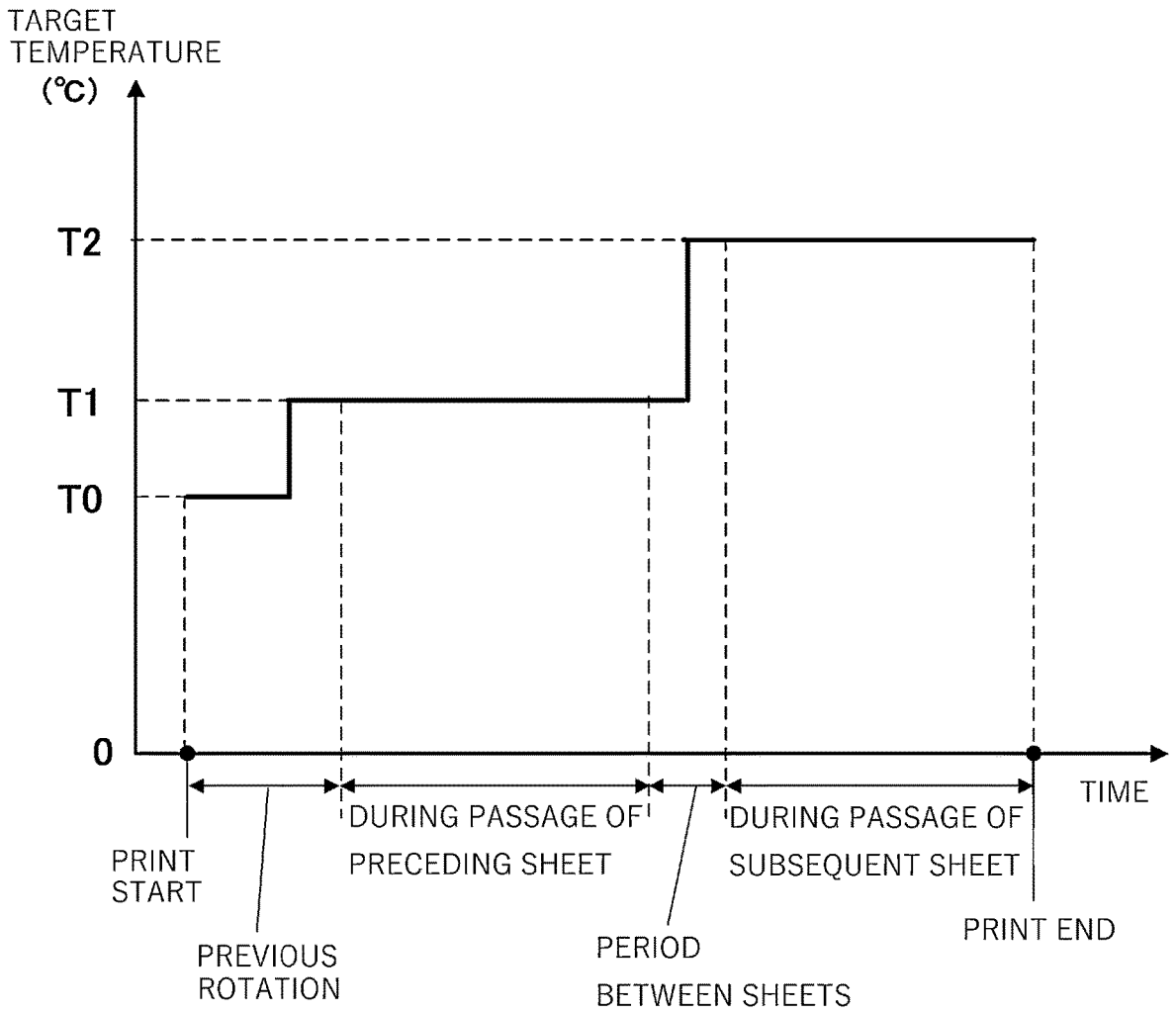
FIG. 4 is a view for explaining a conventional target temperature control sequence.

Herein, FIG. 4 shows a control sequence of the target temperature of the heater 11 by the conventional engine control unit 302. During previous rotation (a period from when the printing operation is started to when the tip of the first sheet of the recording material P enters the fixing nip portion Nf), the engine control unit 302 controls power supply to the heater 11 such that a target temperature TO is maintained. The target temperature TO at this point is set to 170° C. Subsequently, the target temperature is switched to a target temperature T1 (first temperature) of the first sheet of the recording material before the first sheet of the recording material (a first recording material and is also written as "preceding sheet") is passed.

During the passage of the preceding sheet (a period from when the tip of the first sheet of the recording material enters the fixing nip portion Nf to when the rear end of the first sheet of the recording material passes through the fixing nip portion Nf), the engine control unit 302 controls power supply to the heater 11 so as to maintain the target temperature T1. The target temperature T1 during the passage of the sheet is in a range of not less than 170° C. and not more than 204° C., and is determined by a calculation method described later.

With regard to a period between sheets (a period from when the rear end of the preceding sheet passes through the fixing nip portion Nf to when a subsequent sheet enters the fixing nip portion Nf), after the engine control unit 302 controls power supply to the heater 11 so as to maintain the target temperature T1, the engine control unit 302 switches the target temperature to a target temperature T2 (second temperature) of the second sheet of the recording material during the period between sheets before the second sheet of the recording material (a second recording material and is also written as "subsequent sheet") is passed.

Subsequently, during the passage of the subsequent sheet (a period from when the tip of the second sheet of the recording material enters the fixing nip portion Nf to when the rear end of the second sheet of the recording material passes through the fixing nip portion Nf), the engine control unit 302 controls power supply to the heater 11 so as to maintain the target temperature T2. Similarly to T1, the target temperature T2 during the passage of the sheet is in a range of not less than 170° C. and not more than 204° C., and is determined by a calculation method described later.

Image Processing Section

Calculation of Target Temperature from Image Data

The image processing unit 303 has a processor such as a CPU and a memory such as a ROM or a RAM. Note that an information processing apparatus which functions as the engine control unit 302 may be caused to function as the image processing unit 303. The image processing unit 303 performs processing for calculating the target temperature from image data in addition to halftoning of a gray-scale image. In the following example, a description will be given of processing of the image processing unit 303 in the case where a toner image corresponding to image data is formed on the surface of one sheet of the recording material P.

In target temperature determination based on image density information of a divided area, the image processing unit 303 divides image data into areas and regions, and classifies the individual regions into seven representative values. Next, the representative value based on the classification is converted to an addition amount of temperature in each region, and the addition amount is added in a sub scanning direction. Subsequently, the maximum value is selected from addition values in a plurality of main scanning areas, the value is added to a base temperature, and a target temperature T is calculated. Hereinbelow, each step will be described sequentially. Note that the target temperature calculation method is not limited thereto, and it is only required that temperature corresponding to a printing amount is determined.

Division of Image Data

Figure 5:
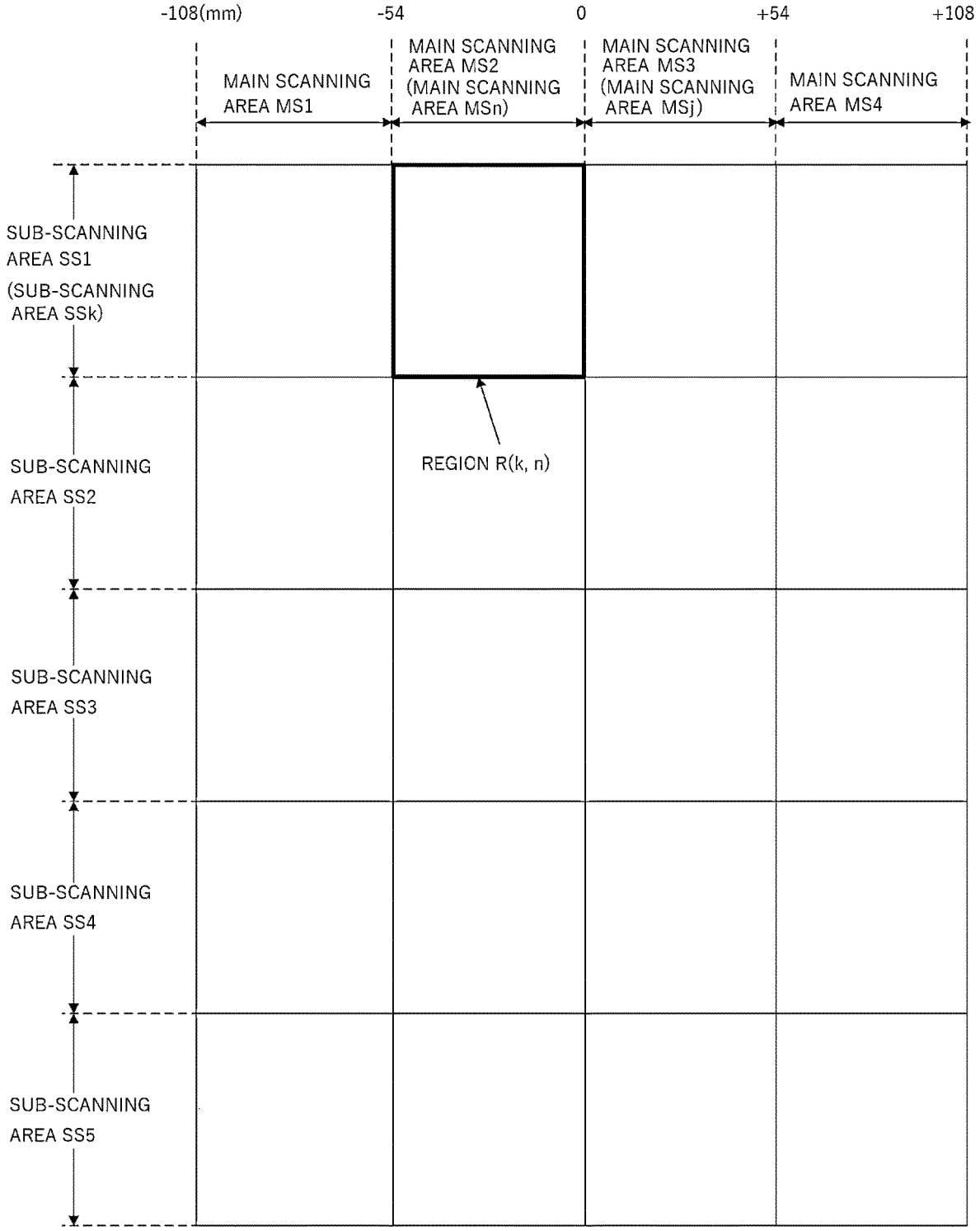
FIG. 5 is a view for explaining division of image data of the embodiment.

Division of image data by the image processing unit 303 will be described with reference to FIG. 5. In the following description, "sub scanning direction" is a transport direction of the recording material P, and "main scanning direction" is a direction orthogonal to the sub scanning direction. In addition, as shown in the drawing, "sub scanning area" denotes areas obtained by dividing image data in the sub scanning direction such that the areas are arranged continuously, and "main scanning area" denotes areas obtained by dividing image data in the main scanning direction such that the areas are arranged continuously.

Main Scanning Area Division Step

The image processing unit 303 provides the main scanning areas by dividing the whole area of image data in the main scanning direction. In the present embodiment, the number of times of the division is set to 4. Herein, the center of a sheet when a sheet having the LTR size (short side of 216 mm) is fed to the heating and fixing apparatus is set as the origin on the heating and fixing apparatus, and a coordinate of the origin is set to 0 mm. In addition, the left side with respect to the transport direction is defined as a negative side, and the right side therewith is defined as a positive side. In the present embodiment, as shown in Table 1 and FIG. 5, the individual main scanning areas are set. That is, a main scanning area MS1 is in a range of −108 mm to −54 mm, a main scanning area MS2 is in a range of −54 mm to 0 mm, a main scanning area MS3 is in a range of 0 mm to +54 mm, and a main scanning area MS4 is in a range of +54 mm to +108 mm.

TABLE 1

| Main Scanning Area MS | Area Range |
|---|---|
| 1 | −108 mm~−54 mm |
| 2 | −54 mm~0 mm |
| 3 | 0 mm~+54 mm |
| 4 | +54 mm~+108 mm |

Sub-Scanning Area Division Step

The image processing unit 303 provides the sub scanning areas by dividing the whole area of image data in the sub scanning direction. In the present embodiment, the number of times of the division is set to 5. An image start position is set as the origin on the heating and fixing apparatus, and a coordinate of the origin is set to 0 mm. In the present embodiment, as shown in Table 2 and FIG. 5, the individual sub scanning areas are set. That is, a sub scanning area SS1 is in a range of 0 mm to 56 mm, a sub scanning area SS2 is in a range of 56 mm to 112 mm, a sub scanning area SS3 is in a range of 112 mm to 168 mm, a sub scanning area SS4 is in a range of 168 mm to 224 mm, and a sub scanning area SS5 is in a range of 224 mm to 280 mm. Note that the sub scanning area range is set to 56 mm in order to cause the length of the sub scanning area in the sub scanning direction to substantially match the peripheral length of the fixing film 13 in the present embodiment. The reason for this length will be described later in the part of determination processing of the target temperature T. Herein, "substantially match" denotes that the lengths don't need to be completely identical to each other, but it is preferable to cause the lengths to match each other to such a degree that the effect of suppressing a reduction in temperature is obtained.

TABLE 2

| Sub Scanning Area SS | Area Range |
|---|---|
| 1 | 0 mm~56 mm |
| 2 | 56 mm~112 mm |
| 3 | 112 mm~168 mm |
| 4 | 168 mm~224 mm |
| 5 | 224 mm~280 mm |

Region Setting Step

The image processing unit 303 sets one area defined by the main scanning area and the sub scanning area as a region. Hereinbelow, a range defined by a main scanning area MSn and a sub scanning area SSk is referred to as "region R (k, n)".

Ranking of Region

The image processing unit 303 calculates a printing amount in the region R (k, n).

Count of High-Density Pixel

First, the image processing unit 303 extracts a high-density pixel having a gray density of not less than 4% in each region. Subsequently, the total number of high-density pixels in the region R (k, n) is counted, and is set as N (k, n) (pieces).

Then, the image processing unit 303 classifies the total number of high-density pixels N (k, n) in the region R (k, n) into seven-level ranks including Rank 0 to Rank 6 based on Table 3.

TABLE 3

| Rank | Total Number of High-Density Pixels N (k, n) |
|---|---|
| 0 | 0~1316 |
| 1 | 1317~31080 |
| 2 | 31081~62160 |
| 3 | 62161~124320 |
| 4 | 124321~248640 |
| 5 | 248641~497280 |
| 6 | 497281~ |

The rank of the printing amount in the region R (k, n) calculated in this manner is indicated by Rank (k, n). With the processing procedure described above, it is possible to integrate printing amount information of the whole area of the image data into rank information having seven levels for each of twenty regions.

Determination of Target Temperature T

Subsequently, the image processing unit 303 determines the target temperature T based on the rank of the printing amount of each region. Hereinbelow, the determination of the target temperature T will be described together with an expected printing shape and a phenomenon related thereto.

Expected Image and Influence of Temperature Reduction

First, before description of specific processing contents, as an expected image which is significantly influenced by temperature reduction, image data with which vertical band-shaped printing is performed will be discussed for each rank. That is, when the rank of the printing amount of each region is determined, the image processing unit 303 assumes that rectangular printing (hereinafter referred to as vertical band-shaped printing) which spreads fully in the sub scanning direction in the region is performed with a width of the number of pixels based on the rank. In addition, the image processing unit 303 assumes the target temperature at which the vertical band-shaped printing can be adequately fixed.

For example, when the length in the sub scanning direction is 56.5 mm, the width of the vertical band-shaped printing in the main scanning direction is assumed in the following manner. The width thereof is 0.042 mm when the rank is Rank 0, 1 mm when the rank is Rank 1, 2 mm when the rank is Rank 2, 4 mm when the rank is Rank 3, 8 mm when the rank is Rank 4, 16 mm when the rank is Rank 5, and the entire width of the region in the main scanning direction when the rank is Rank 6. The reason for this assumption is that such vertical band-shaped printing needs the highest target temperature T in the rank of a certain printing amount. That is, when toner is disposed in the shape of a vertical band, heat is continuously taken from a specific position in the main scanning direction of a member (the fixing film 13 or the heater 11) which performs heating of the heating and fixing apparatus 6. As a result, the temperature of the portion is reduced and fixing performance deteriorates. Therefore, in order to compensate for heat which is reduced, it is necessary to increase the target temperature T.

When the thickness of the vertical band in the main scanning direction is small, heat flowing in from surrounding members compensates for such a temperature reduction phenomenon, and hence the temperature reduction phenomenon can be almost neglected. However, as the vertical band becomes thicker, it becomes more difficult for the heat to flow into a central portion of the vertical band, and hence the degree of the temperature reduction is increased, the temperature reduction can be no longer neglected, and the higher target temperature T becomes necessary.

Figure 6:
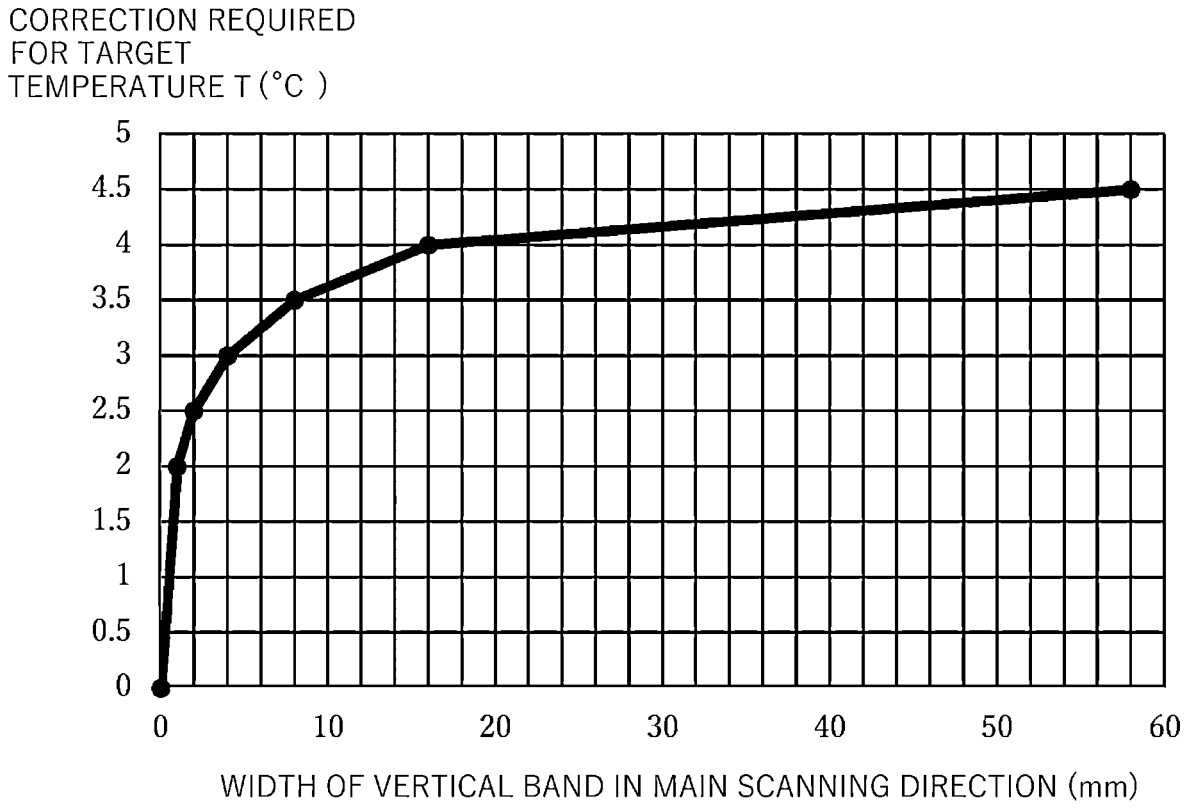
FIG. 6 is a view showing a relationship between the width of vertical band-shaped printing and a correction amount of a target temperature of the embodiment.

FIG. 6 shows a relationship between the width of the vertical band in the main scanning direction and a correction amount of the target temperature T. Herein, the target temperature T required to fix a vertical band having a width of 0.042 mm and a length in the transport direction of 56.5 mm is used as a reference. At this point, the target temperature T required to fix a vertical band having a width of 1 mm is higher by 2° C. In addition, the target temperature T required to fix a vertical band having a width of 16 mm is higher by 4° C. Note that, when the width in the main scanning direction becomes wider, a rise rate of the target temperature T becomes gentler. When the width exceeds 58 mm, the influence of inflow of heat from the outside of the vertical band is almost eliminated, and hence further temperature correction becomes unnecessary.

Note that, in the description of the present embodiment, a configuration is adopted in which a basic value of the target temperature is set, and the correction amount (addition amount) to the basic value is calculated based on image data. However, the method is not limited to the above method as long as the target temperature can be calculated finally based on the image data. For example, a method in which the target temperature is directly calculated based on the image data without setting the basic value or the correction amount may also be adopted.

Figure 7:
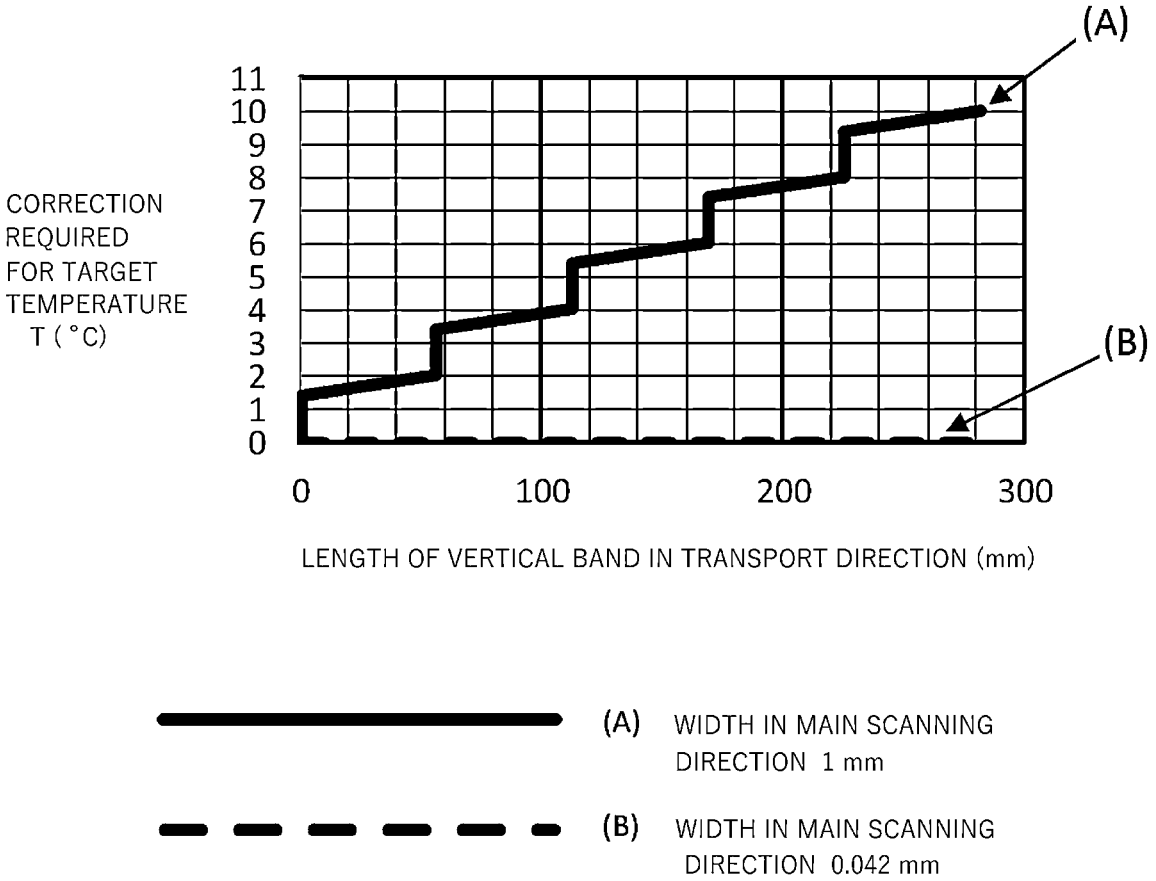
FIG. 7 is a view showing a relationship between the length of the vertical band-shaped printing and the correction amount of the target temperature of the embodiment.

Note that the temperature reduction phenomenon becomes more significant as the length of the vertical band in the sub scanning direction becomes longer and, in particular, the temperature reduction phenomenon becomes conspicuous when the length in the sub scanning direction exceeds a length obtained by constant multiplication of the peripheral length of the fixing film 13. FIG. 7 is a graph showing a relationship between the length of the vertical band in the transport direction (sub scanning direction) and the correction amount of the target temperature T required for the compensation for the temperature reduction.

In the case of the vertical band having a width in the main scanning direction of 0.042 mm, even when the length in the sub scanning direction is 56.5 mm or 287 mm which corresponds to the length of the image in an A4 size, the required correction amount of the target temperature T is unchanged. This is because, when the width is about 0.042 mm, the inflow of heat from surrounding areas is adequate, and hence local temperature reduction of a member can be neglected.

On the other hand, in the case of the vertical band having a width in the main scanning direction of 1 mm, the degree of the temperature reduction of the member is large, and hence the required correction amount of the target temperature T is increased in proportion to the length in the transport direction. At this point, as shown in FIG. 7, when the length obtained by constant multiplication of the peripheral length of the fixing film 13 is exceeded, the required correction amount of the target temperature T rises conspicuously. This is because the rotating fixing film 13 comes into contact with toner and performs fixing in a state in which heat is taken from the fixing film 13 in the vertical band in the immediately previous rotation.

To cope with this, as described above, when the length in the sub scanning direction in the sub scanning area division is caused to substantially match the peripheral length of the fixing film 13, it is possible to perform arithmetic calculation in which this phenomenon is reflected, and hence higher power consumption reduction effect is obtained. Herein, "the length in the sub scanning direction substantially matches the peripheral length of the fixing film 13" denotes that, even when the lengths are not exactly identical to each other, it is only required that the lengths match each other to such a degree that the influence of the temperature reduction can be neglected.

Calculation of Target Temperature T

Based on the above-described preconditions, a specific calculation method of the target temperature T will be described. The target temperature T is calculated by determining the required correction amount in the case where the printing amount rank of the region is other than 0 as an addition amount ΔT by using, as a base, a temperature in the case where the printing amount rank of the region is 0.

First, in the present embodiment, a temperature required to fix the vertical band having a width of 0.042 mm which corresponds to Rank 0 is 170° C. The addition amount required in the case where each region corresponds to any Rank other than Rank 0 is defined based on FIG. 6, and is shown in Table 4. Based on this, the printing amount rank of the region R (k, n) is converted to the addition amount ΔT (k, n).

TABLE 4

| Printing Amount Rank | Corresponding Width of Vertical Band (mm) | Required Addition Amount ΔT (° C.) |
|---|---|---|
| 0 | 0.042 | 0 |
| 1 | 1 | 2 |
| 2 | 2 | 2.5 |
| 3 | 4 | 3 |
| 4 | 8 | 3.8 |
| 5 | 16 | 4.2 |
| 6 | 58 | 4.5 |

Next, the addition amount ΔT (k, n) is added to five regions (region column) continuously arranged in the sub scanning direction, and $\Delta T_{MSn}$ is calculated as a candidate value of the correction amount of the target temperature.

That is, for five main scanning areas which satisfy n=1 to 4, values obtained by adding ΔT (1, n), ΔT (2, n), ΔT (3, n), ΔT (4, n), and ΔT (5, n) to the five main scanning areas are calculated as $\Delta T_{MSn}$. This corresponds to a proportional rise of the required target temperature T when the vertical bands corresponding to the printing amount ranks are disposed in five regions which are arranged in the sub scanning direction. That is, the addition amount ΔT (k, n) is a conversion value from image density in the region which is used for calculating the candidate value $\Delta T_{MSn}$ in the main scanning area MSn in which the region R (k, n) is included.

Consequently, a temperature obtained by adding a basic temperature (herein, 170° C.) to the largest value selected from among the calculated four candidate values $\Delta T_{MS1}$, $\Delta T_{MS2}$, $\Delta T_{MS3}$, and $\Delta T_{MS4}$ is determined to be the target temperature T.

Evaluation Example

Figure 8A:
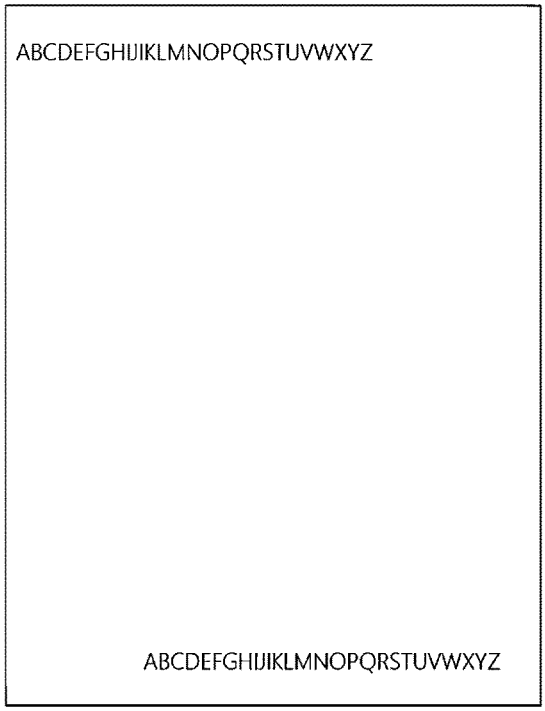
FIGS. 8A to 8D are views showing images for evaluation according to the embodiment.
Figure 8B:
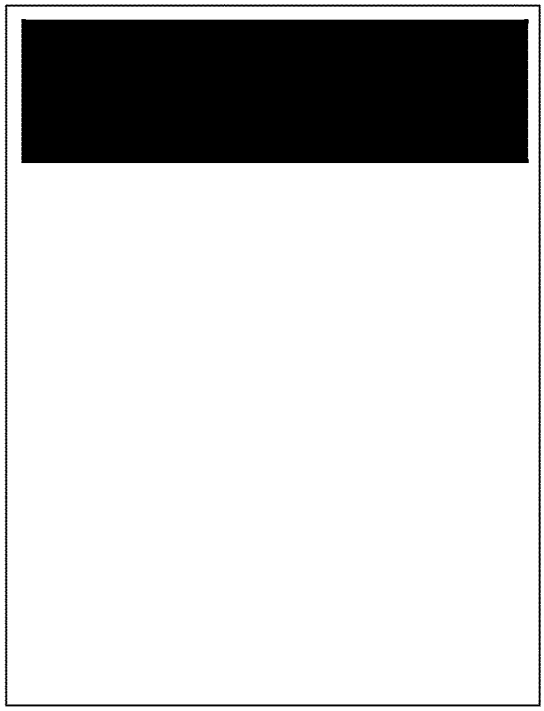
Figure 8C:
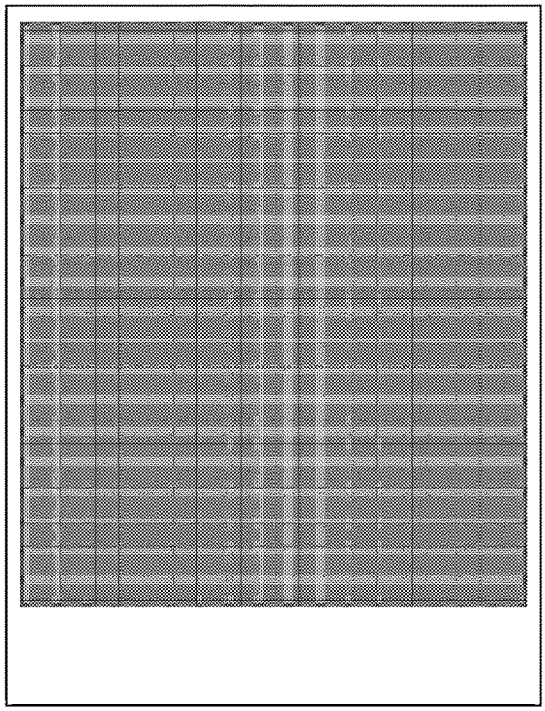
Figure 8D:
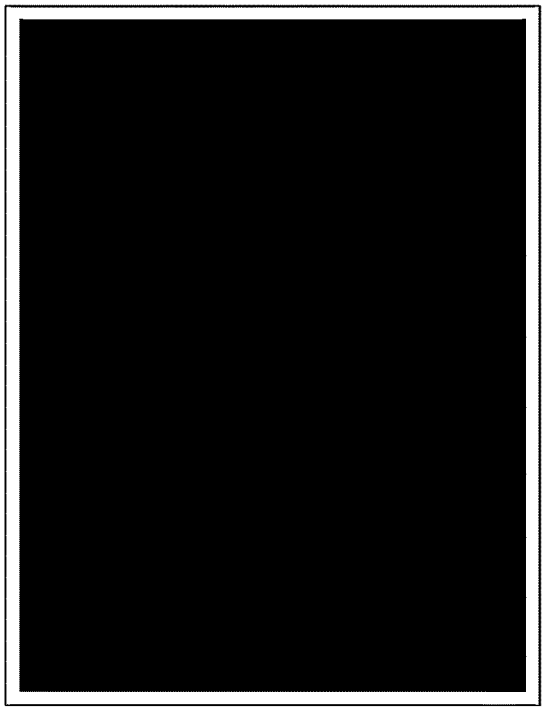

A description will be given of an evaluation example for determining that desired power consumption reduction effect is obtained by the determination method of the present embodiment. FIGS. 8A to 8D show four types of images. FIG. 8A shows an example of a text image in which the printing amount is small, FIG. 8B shows an example of an image in which the printing amount of a tip is large, FIG. 8C shows an example of a 10% halftone image, and FIG. 8D shows an example of an entire solid black image. A fixing target temperature of each of the images is determined based on the determination method of the present embodiment, and the presence or absence of a fixing failure and power consumption are evaluated.

First, the determination of the target temperature is performed for the image in FIG. 8A. Information on the printing amount rank calculated from the image is as shown in Table 5.

TABLE 5

| | | Main Scanning Area MS | | | |
|---|---|---|---|---|---|
| | | 1 | 2 | 3 | 4 |
| Sub Scanning Area SS | 1 | 2 | 2 | 0 | 0 |
| | 2 | 0 | 0 | 0 | 0 |
| | 3 | 0 | 0 | 0 | 0 |
| | 4 | 0 | 0 | 0 | 0 |
| | 5 | 0 | 0 | 2 | 2 |

Next, when this printing amount rank is converted to the addition amount ΔT of the temperature of each of each region and each region column, the conversion result is as shown in Table 6. As a result, when the correction value of 2.5° C. is added to 170° C. and the fractional portion is rounded up, the target temperature of this evaluation image is 173° C.

TABLE 6

| | | Main Scanning Area MS | | | |
|---|---|---|---|---|---|
| | | 1 | 2 | 3 | 4 |
| Sub Scanning Area SS | 1 | 2.5 | 2.5 | 0 | 0 |
| | 2 | 0 | 0 | 0 | 0 |
| | 3 | 0 | 0 | 0 | 0 |
| | 4 | 0 | 0 | 0 | 0 |
| | 5 | 0 | 0 | 2.5 | 2.5 |
| $\Delta T_{MSn}$ | | 2.5 | 2.5 | 2.5 | 2.5 |

Similarly, the determination of the target temperature is performed for the image in FIG. 8B. Information on the printing amount rank calculated from the image is as shown in Table 7.

TABLE 7

| | | Main Scanning Area MS | | | |
|---|---|---|---|---|---|
| | | 1 | 2 | 3 | 4 |
| Sub Scanning Area SS | 1 | 6 | 6 | 6 | 6 |
| | 2 | 3 | 3 | 3 | 3 |
| | 3 | 0 | 0 | 0 | 0 |
| | 4 | 0 | 0 | 0 | 0 |
| | 5 | 0 | 0 | 0 | 0 |

Next, when this printing amount rank is converted to the addition amount ΔT of the temperature of each of each region and each region column, the conversion result is as shown in Table 8. As a result, when the correction value of 7.5° C. is added to 170° C. and the fractional portion is rounded up, the target temperature of this evaluation image is 178° C.

TABLE 8

| | | Main Scanning Area MS | | | |
|---|---|---|---|---|---|
| | | 1 | 2 | 3 | 4 |
| Sub Scanning Area SS | 1 | 4.5 | 4.5 | 4.5 | 4.5 |
| | 2 | 3 | 3 | 3 | 3 |
| | 3 | 0 | 0 | 0 | 0 |
| | 4 | 0 | 0 | 0 | 0 |
| | 5 | 0 | 0 | 0 | 0 |
| $\Delta T_{MSn}$ | | 7.5 | 7.5 | 7.5 | 7.5 |

Similarly, the determination of the target temperature is performed for the image in FIG. 8C. Information on the printing amount rank calculated from the image is as shown in Table 9.

TABLE 9

| | | Main Scanning Area MS | | | |
|---|---|---|---|---|---|
| | | 1 | 2 | 3 | 4 |
| Sub Scanning Area SS | 1 | 4 | 4 | 4 | 4 |
| | 2 | 4 | 4 | 4 | 4 |
| | 3 | 4 | 4 | 4 | 4 |
| | 4 | 4 | 4 | 4 | 4 |
| | 5 | 2 | 2 | 2 | 2 |

Next, when this printing amount rank is converted to the addition amount ΔT of the temperature of each of each region and each region column, the conversion result is as shown in Table 10. As a result, when the correction value of 17.7° C. is added to 170° C. and the fractional portion is rounded up, the target temperature of this evaluation image is 188° C.

TABLE 10

| | | Main Scanning Area MS | | | |
|---|---|---|---|---|---|
| | | 1 | 2 | 3 | 4 |
| Sub Scanning Area SS | 1 | 3.8 | 3.8 | 3.8 | 3.8 |
| | 2 | 3.8 | 3.8 | 3.8 | 3.8 |
| | 3 | 3.8 | 3.8 | 3.8 | 3.8 |

TABLE 10-continued

| | | Main Scanning Area MS | | | |
|---|---|---|---|---|---|
| | | 1 | 2 | 3 | 4 |
| | 4 | 3.8 | 3.8 | 3.8 | 3.8 |
| | 5 | 2.5 | 2.5 | 2.5 | 2.5 |
| $\Delta T_{MSn}$ | | 17.7 | 17.7 | 17.7 | 17.7 |

Similarly, the determination of the target temperature is performed for the image in FIG. 8D. Information on the printing amount rank calculated from the image is as shown in Table 11.

TABLE 11

| | | Main Scanning Area MS | | | |
|---|---|---|---|---|---|
| | | 1 | 2 | 3 | 4 |
| Sub Scanning Area SS | 1 | 6 | 6 | 6 | 6 |
| | 2 | 6 | 6 | 6 | 6 |
| | 3 | 6 | 6 | 6 | 6 |
| | 4 | 6 | 6 | 6 | 6 |
| | 5 | 6 | 6 | 6 | 6 |

Next, when this printing amount rank is converted to the addition amount ΔT of the temperature of each of each region and each region column, the conversion result is as shown in Table 12. As a result, when the correction value of 22.5° C. is added to 170° C. and the fractional portion is rounded up, the target temperature of this evaluation image is 193° C.

TABLE 12

| | | Main Scanning Area MS | | | |
|---|---|---|---|---|---|
| | | 1 | 2 | 3 | 4 |
| Sub Scanning Area SS | 1 | 4.5 | 4.5 | 4.5 | 4.5 |
| | 2 | 4.5 | 4.5 | 4.5 | 4.5 |
| | 3 | 4.5 | 4.5 | 4.5 | 4.5 |
| | 4 | 4.5 | 4.5 | 4.5 | 4.5 |
| | 5 | 4.5 | 4.5 | 4.5 | 4.5 |
| $\Delta T_{MSn}$ | | 22.5 | 22.5 | 22.5 | 22.5 |

Thus, the target temperatures in FIGS. 8A to 8D are summarized in Table 13.

TABLE 13

| | $\Delta T_{MS1}$ | $\Delta T_{MS2}$ | $\Delta T_{MS3}$ | $\Delta T_{MS4}$ | Target Temperature T (° C.) |
|---|---|---|---|---|---|
| Image (a) | 2.5 | 2.5 | 2.5 | 2.5 | 173 |
| Image (b) | 7.5 | 7.5 | 7.5 | 7.5 | 178 |
| Image (c) | 17.7 | 17.7 | 17.7 | 17.7 | 188 |
| Image (d) | 22.5 | 22.5 | 22.5 | 22.5 | 193 |

Comparative Example 1-1

As Comparative Example 1-1, a conventional example in the case where the image (a) and the image (b) are successively printed is shown. The target temperature (first temperature) of the image (a) of the preceding sheet is 173° C., the target temperature (second temperature) of the image (b) of the subsequent sheet is 178° C., and a target temperature difference between the preceding sheet and the subsequent sheet is Δ5° C.

Figure 9:
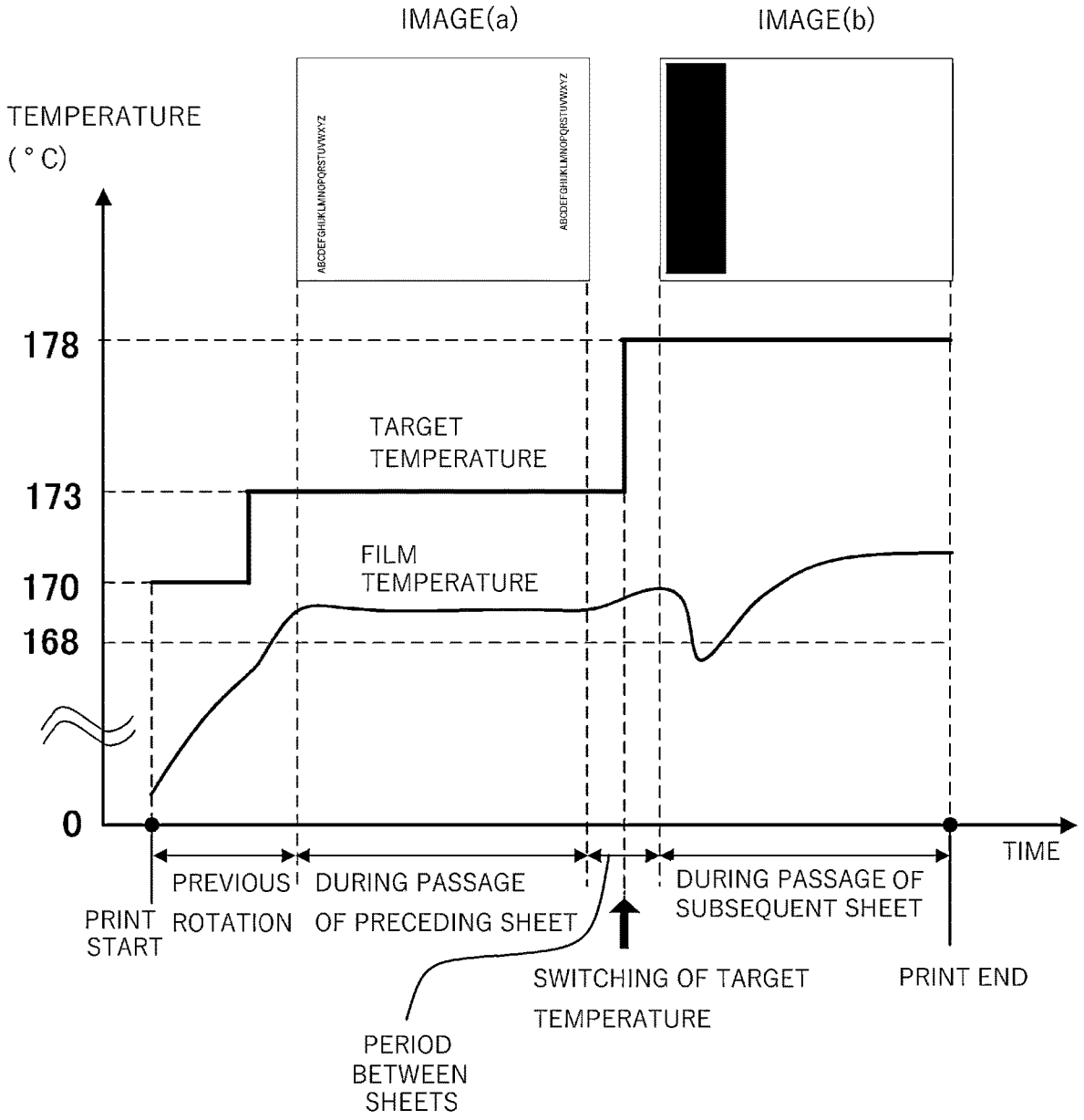
FIG. 9 is an explanatory view of conventional control in which a high-print image is printed after a low-print image.

FIG. 9 shows changes of the target temperature and a film temperature. The film temperature is obtained by measuring a film surface temperature in a downstream portion of the fixing nip portion Nf with a radiation pyrometer. When the film temperature exceeds 168° C., it is possible to secure fixability. In Comparative Example 1-1, as indicated by an arrow in FIG. 9, the target temperature is switched from the target temperature of the preceding sheet to the target temperature of the subsequent sheet at timing at which a position 33 mm ahead of the tip of the subsequent sheet reaches the fixing nip portion Nf (165 msec before the position reaches the fixing nip portion Nf in terms of time) in a period between sheets.

In Comparative Example 1-1, the printing rate of the image (a) of the preceding sheet is low, and the determined target temperature is also low. Consequently, electric power supplied to the fixing heater is small and the endothermic quantity of the fixing member is small, and hence, immediately after the passage of the preceding sheet, the heat storage quantity of each of the film unit 10 and the pressure roller 20 is small. In such a state, in the case where a high-print image is printed at the tip of the subsequent sheet as in the image (b), the film temperature is quickly reduced due to endotherm by toner and paper.

As shown in FIG. 9, in spite of the fact that the target temperature is switched from the target temperature of the preceding sheet to the target temperature of the subsequent sheet at the timing at which the position 33 mm ahead of the tip of the subsequent sheet reaches the fixing nip portion Nf, and the target temperature is set to be high, the film temperature cannot follow at the tip portion of the subsequent sheet, and sharp temperature reduction occurs. As a result, the film temperature becomes lower than 168° C. temporarily, and a fixing failure occurs in the high-print portion of the subsequent sheet.

Embodiment 1-1

As Embodiment 1-1, the present embodiment in the case where the image (a) and the image (b) are successively printed is shown. Similarly to Comparative Example 1-1, the target temperature (first temperature) of the image (a) of the preceding sheet is 173° C., the target temperature (second temperature) of the image (b) of the subsequent sheet is 178° C., and the target temperature difference between the preceding sheet and the subsequent sheet is Δ5° C.

In Embodiment 1-1, the printing rate of the image (a) of the preceding sheet is low, and the determined target temperature is also low. Consequently, electric power supplied to the fixing heater is small and the endothermic quantity of the fixing member is also small, and hence, immediately after the passage of the preceding sheet, the heat storage quantity of each of the film unit 10 and the pressure roller 20 is small. In such a state, in the case where the high-print image is printed at the tip of the subsequent sheet as in the image (b), the film temperature is quickly reduced due to endotherm by toner and paper, and a fixing failure is expected to occur.

Figure 10:
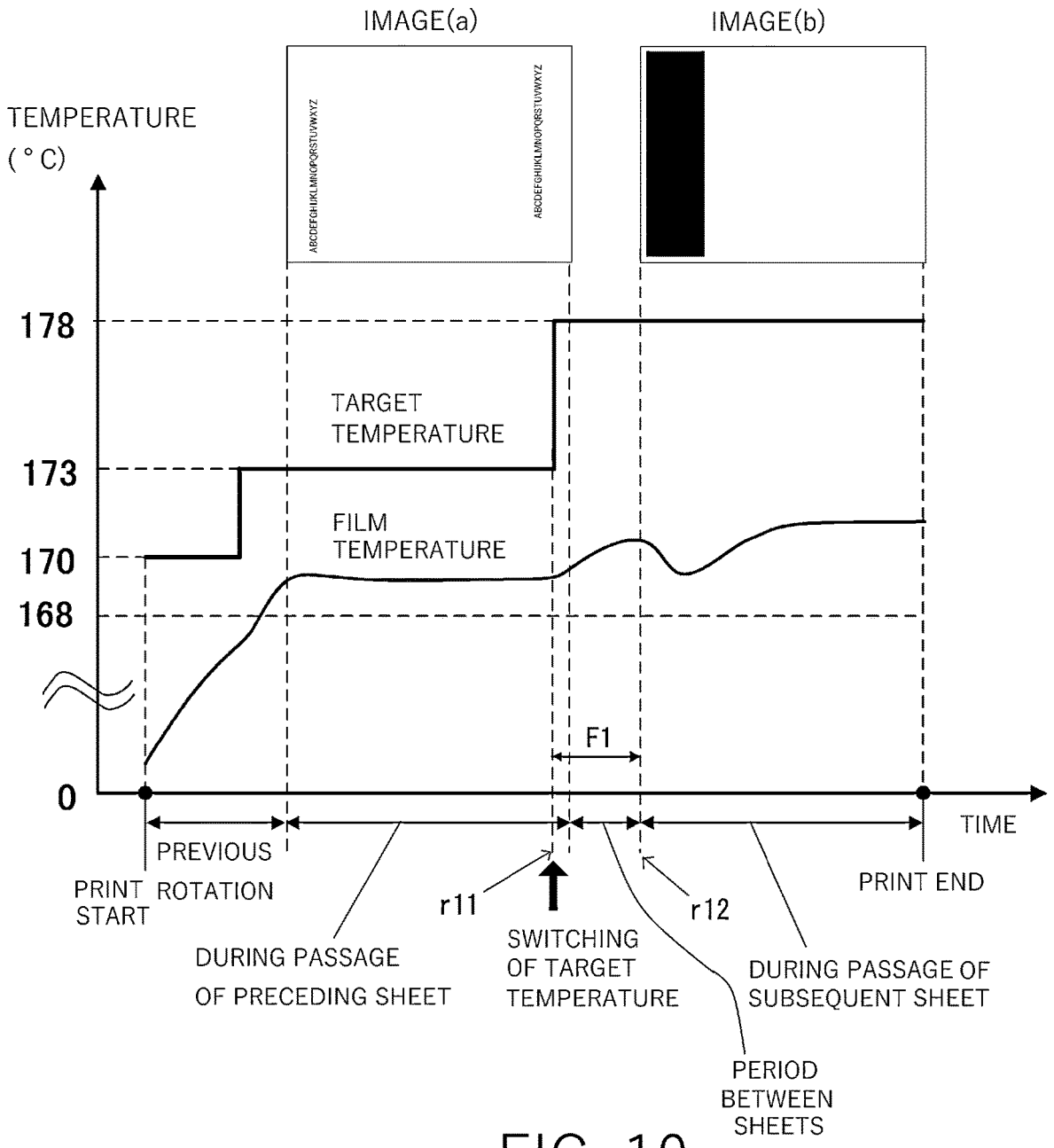
FIG. 10 is an explanatory view of control according to the embodiment in which the high-print image is printed after the low-print image.

To cope with this, in the present embodiment, the target temperature is switched from the target temperature of the preceding sheet to the target temperature of the subsequent sheet at timing indicated by an arrow in FIG. 10 at which a position 5 mm ahead of the rear end of the preceding sheet reaches the fixing nip portion Nf. By making the timing at which the target temperature is switched to the target temperature of the subsequent sheet earlier than that in Comparative Example 1-1, it is made possible to secure the heat storage quantity before the tip of the subsequent sheet enters the fixing nip portion Nf. Note that the target temperature is switched in a margin portion of the rear end of the preceding sheet. That is, the switching of the target temperature is performed at timing after a portion of the preceding sheet on which a toner image is formed passes through the fixing nip portion Nf even in the case where the switching of the target temperature is performed early. Accordingly, the image of the preceding sheet is not influenced.

In the control in FIG. 10, the target temperature of the preceding sheet (first recording material) is set as a first temperature, and the target temperature of the subsequent sheet (second recording material) is set as a second temperature. In the embodiment, the second temperature is a temperature higher than the first temperature. In addition, Δ5° C. which is the difference between the second temperature and the first temperature is set as a first value. Further, when a first period is indicated by F1, the switching of the target temperature is performed from timing (r11) which is earlier than timing (r12) at which the subsequent sheet (second recording material) reaches the fixing nip portion Nf by the first period.

As can be seen from the change of the film temperature shown in FIG. 10, in a period between the preceding sheet and the subsequent sheet, the film temperature rises and heat storage is performed in this period. In addition, even when the tip of the subsequent sheet enters the fixing nip portion Nf, the film temperature reduction is suppressed, and a temperature of not less than 168° C. can be maintained. Accordingly, a fixing failure does not occur in the high-print portion of the subsequent sheet.

Comparative Example 1-2

As Comparative Example 1-2, a conventional example in the case where the image (c) and the image (d) are successively printed is shown. The target temperature (third temperature) of the image (c) of the preceding sheet (third recording material) is 188° C., the target temperature (fourth temperature) of the image (d) of the subsequent sheet (fourth recording material) is 193° C., and the target temperature difference between the preceding sheet and the subsequent sheet is Δ5° C. which is identical to those in Comparative Example 1-1 and Embodiment 1-1. In Comparative Example 1-2, the printing rate of the image (c) of the preceding sheet is high, and the determined target temperature is also high. Consequently, electric power supplied to the fixing heater is large and the endothermic quantity of the fixing member is also large, and hence, immediately after the passage of the preceding sheet, the heat storage quantity of each of the film unit 10 and the pressure roller 20 is large. In such a state, in the case where a high-print image such as the image (d) is printed on the subsequent sheet, a higher target temperature is set, and hence a film temperature rise at the tip portion of the subsequent sheet is large.

Figure 11:
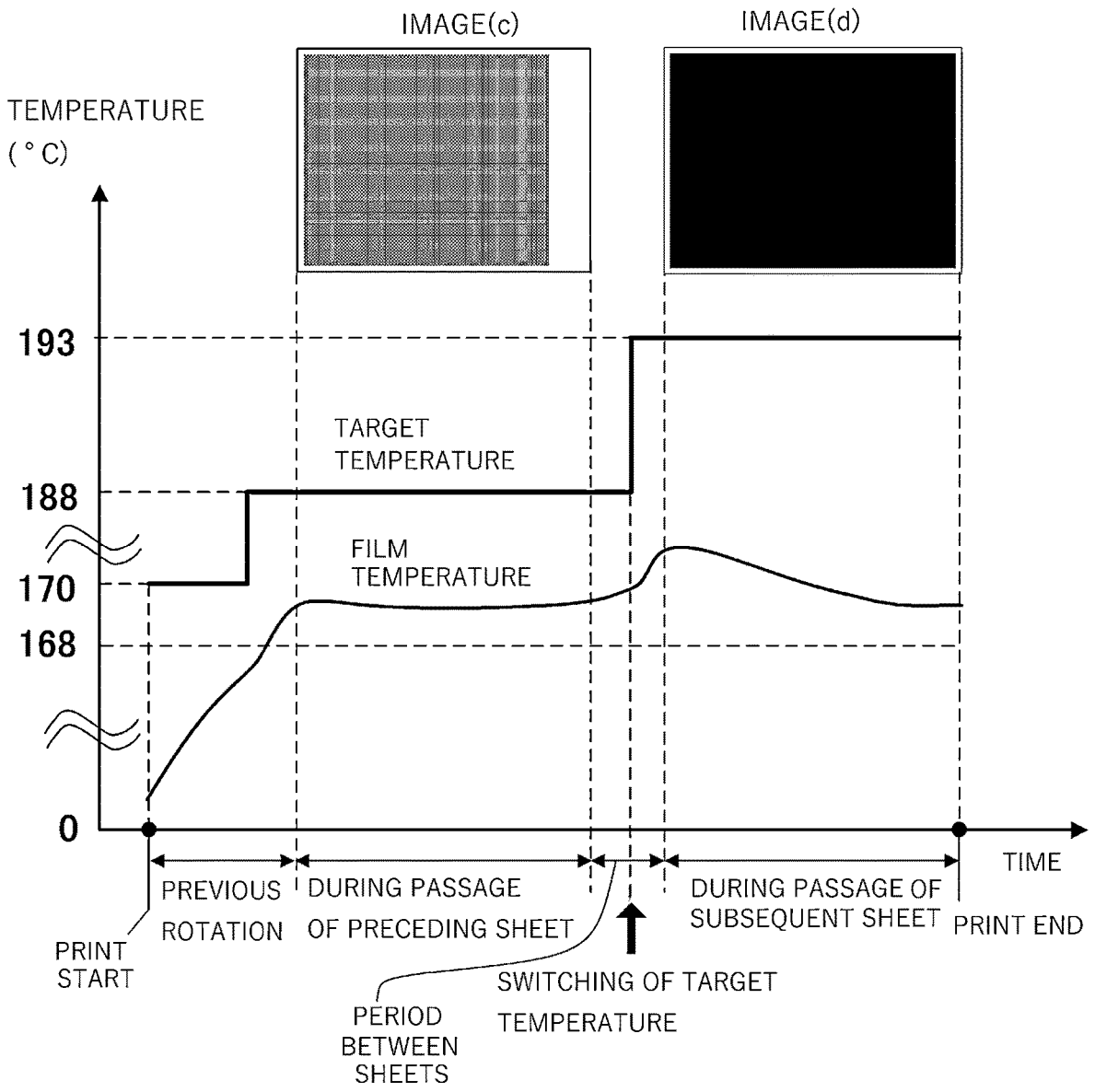
FIG. 11 is an explanatory view of conventional control in which the high-print image is printed after a medium-print image.

As shown in FIG. 11, in the case where the target temperature is switched from the target temperature of the preceding sheet to the target temperature of the subsequent sheet at the timing at which the position 33 mm ahead of the tip of the subsequent sheet reaches the fixing nip portion Nf (165 msec before the position reaches the fixing nip portion Nf in terms of time), the film temperature significantly exceeds 168° C. at the tip of the sheet and the heat storage quantity is large, and hence film temperature reduction is gentle toward the rear end of the sheet thereafter. Accordingly, redundant electric power is supplied from the tip portion of the subsequent sheet to the middle portion thereof, and power consumption is large.

Embodiment 1-2

As Embodiment 1-2, the present embodiment in the case where the image (c) and the image (d) are successively printed is shown. The target temperature (third temperature) of the image (c) of the preceding sheet (third recording material) is 188° C., the target temperature (fourth temperature) of the image (d) of the subsequent sheet (fourth recording material) is 193° C., and the target temperature difference between the preceding sheet and the subsequent sheet is Δ5° C. which is identical to those in Comparative Example 1-1 and Embodiment 1-1. In Embodiment 1-2, the printing rate of the image (c) of the preceding sheet is high, and the determined target temperature is also high. Consequently, electric power supplied to the fixing heater is large and the endothermic quantity of the fixing member is also large, and hence, immediately after the passage of the preceding sheet, the heat storage quantity of each of the film unit 10 and the pressure roller 20 is large. In the case of such a state, even when a high-print image is printed on the subsequent sheet as in the image (d), the film temperature is not quickly reduced due to endotherm by toner and paper, and a fixing failure does not occur.

Figure 12:
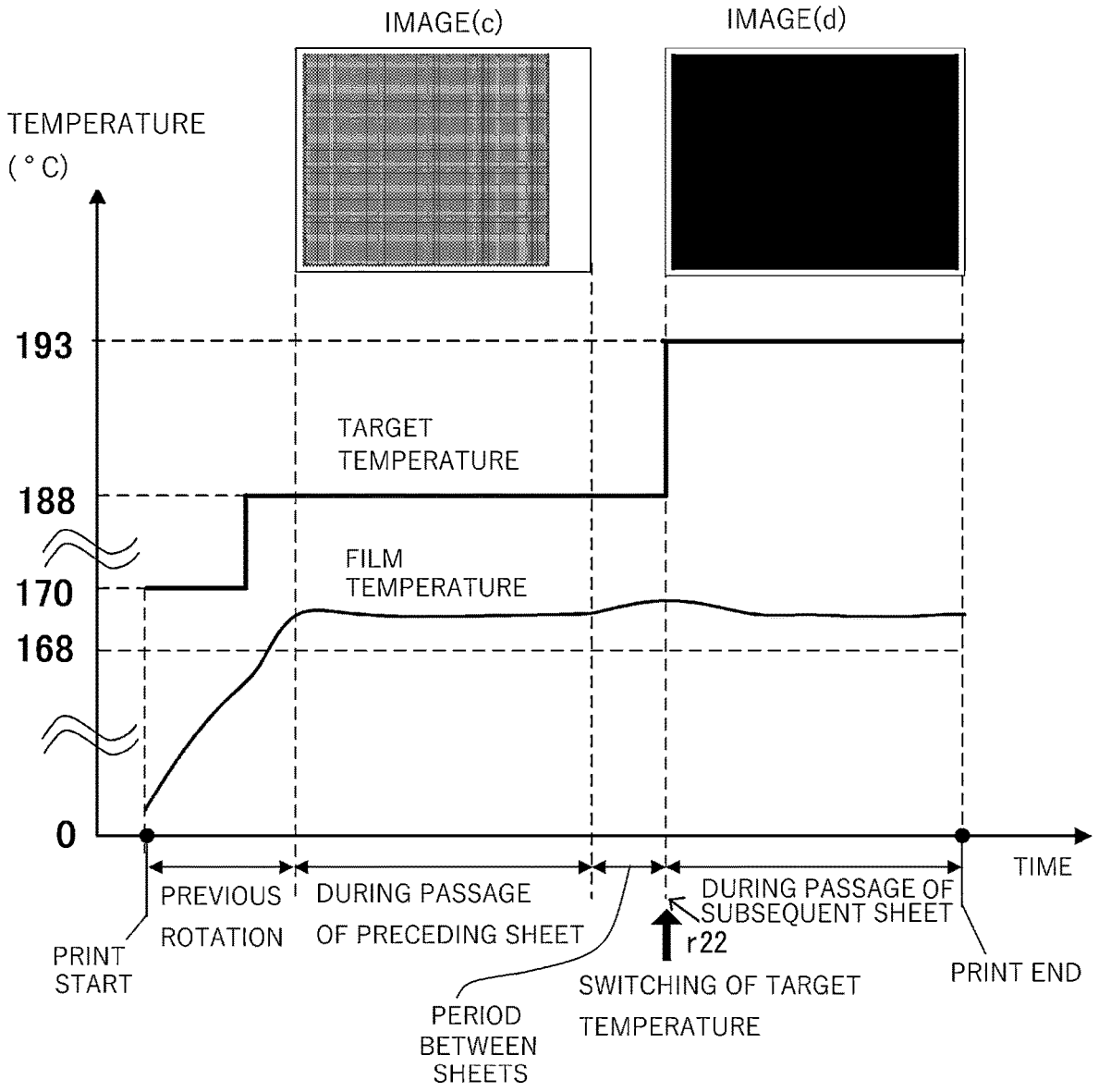
FIG. 12 is an explanatory view of control according to the embodiment in which the high-print image is printed after the medium-print image.

Accordingly, in the present embodiment, the target temperature is switched from the target temperature of the preceding sheet to the target temperature of the subsequent sheet at timing indicated by an arrow in FIG. 12 at which the tip of the subsequent sheet enters the fixing nip portion Nf. The heat storage quantity after the passage of the preceding sheet is adequate, and hence power consumption is reduced by delaying timing at which the target temperature is switched to the target temperature of the subsequent sheet as late as possible. Thus, the switching timing of the target temperature coincides with entry of the tip of the subsequent sheet into the fixing nip portion in the case where the switching timing of the target temperature is late.

As a result of measuring, with a wattmeter, electric power supplied to the heater 11 when the image (c) and the image (d) are repeatedly passed successively until fifty sheets are passed, as shown in Table 14, while the supplied electric power is 15.5 Wh in Comparative Example 1-2, the supplied electric power is 15.2 Wh in Embodiment 1-2. That is, according to the present embodiment, it is possible to reduce power consumption when fifty sheets are passed successively by 0.3 Wh.

TABLE 14

| | Power Consumption when 50 Sheets Are Passed Successively (Wh) |
|---|---|
| Comparative Example 1-2 | 15.5 |
| Embodiment 1-2 | 15.2 |

In the control in FIG. 12, the target temperature of the preceding sheet (third recording material) is set as a third temperature. At this point, the third temperature is 188° C., and the third temperature is higher than 173° C. which is the target temperature (first temperature) of the preceding sheet (first recording material) in Embodiment 1-1. Further, in FIG. 12, the target temperature of the subsequent sheet (fourth recording material) is set as a fourth temperature. At this point, the fourth temperature is 193° C., and hence the fourth temperature is higher than the third temperature, and Δ5° C. which is a difference between the third temperature and the fourth temperature is set as the first value, similarly to the case of Embodiment 1-1.

In the present Embodiment 1-2 having the above conditions, the switching of the target temperature is performed at the same timing as timing (r22) at which the subsequent sheet (fourth recording material) reaches the fixing nip portion Nf. Herein, when the length of a second period is indicated by 0 s, the switching of the target temperature is performed at timing which is earlier than r22 by the second period. With the foregoing, it can be said that the control in Embodiment 1-2 is control in which, in the case where the third temperature is higher than the first temperature, the fourth temperature is higher than the third temperature, and the difference between the fourth temperature and the third temperature has the first value which is identical to that in Embodiment 1-1, the second period is shorter than the first period.

Processing Procedure

Figure 13:
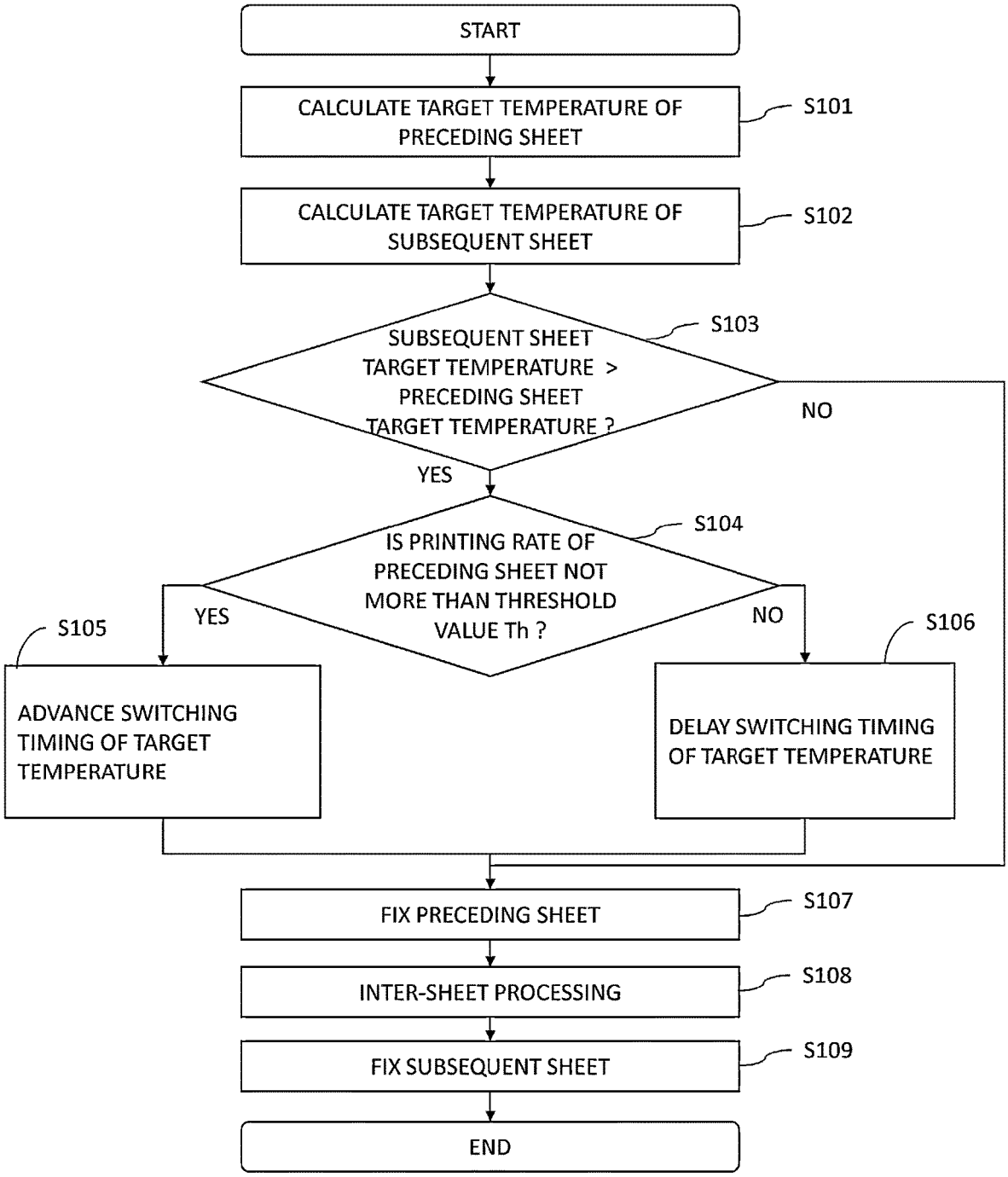
FIG. 13 is a flowchart for explaining processing related to the embodiment.

Hereinbelow, an example of processing control including switching between Embodiment 1-1 and Embodiment 1-2 will be described with reference to a flowchart in FIG. 13. The engine control unit 302 calculates a target temperature T1 of the preceding sheet in Step S101, and calculates a target temperature T2 of the subsequent sheet in Step S102. Subsequently, it is determined whether or not T2>T1 is satisfied in Step S103. When the determination result is NO, the switching of the target temperature is performed at usual timing. For example, when an initial value of the switching timing is a value at the middle between timing of passage of the preceding sheet and timing of entry of the subsequent sheet, the timing at the point of time serves as the switching timing.

On the other hand, when the determination result in S103 is YES, the processing procedure proceeds to Step S104, and it is determined whether or not the printing rate of the preceding sheet is not more than a predetermined threshold value Th. When the printing rate is not more than the threshold value Th, the processing procedure proceeds to S105, and the switching timing is made earlier than usual. With this, processing placing emphasis on suppression of the temperature reduction shown in FIG. 10 is performed. On the other hand, when the printing rate is more than the threshold value Th in S104, the processing procedure proceeds to Step S106, and the switching timing is made later than usual. With this, processing for reducing power consumption shown in FIG. 12 is performed. Note that the determination in S104 may also be replaced with a determination of whether or not the target temperature T1 of the preceding sheet is not more than a predetermined threshold value.

Subsequently, fixing of the preceding sheet is performed in Step S107, inter-sheet processing is performed in Step S108, and fixing of the subsequent sheet is performed in Step S109. Note that the switching of the target temperature is executed at the timing determined in Step S105 or S106.

Effect

As explained in Embodiments 1-1 and 1-2, in the case where the target temperature of the subsequent sheet is higher than the target temperature of the preceding sheet, by setting the switching timing of the target temperature based on the target temperature of the preceding sheet, it is possible to properly control the film temperature of the subsequent sheet. As a result, it becomes possible to prevent a fixing failure caused by temperature reduction even in the case of Embodiment 1-1, and suppress power consumption even in the case of Embodiment 1-2. Note that the value of the target temperature T of each of the preceding sheet and the subsequent sheet is not limited to the example described above, and can be appropriately set according to the configuration and performance of the apparatus. In addition, in the case where a difference D in target temperature between the preceding sheet and the subsequent sheet is not less than a predetermined temperature difference (e.g., not less than 5° C.), target temperature switching control of the present invention may be performed. A threshold value in this case can also be appropriately set according to the configuration and performance of the apparatus as well.

Modification

Among the above embodiments, in Embodiment 1-1 in which the target temperature of the preceding sheet is low, as shown in FIG. 10, the switching timing of the target temperature is advanced to the timing during the passage of the preceding sheet. In addition, in Embodiment 1-2 in which the target temperature of the preceding sheet is high, as shown in FIG. 12, the switching timing of the target temperature is delayed to the timing at the time of the entry of the subsequent sheet. However, the switching timing of the target temperature is not limited to these examples, and it is possible to change the switching timing of the target temperature according to the target temperature of the preceding sheet.

For example, in addition to the timings shown in FIGS. 10 and 12, the switching may be performed at various timings in the period between sheets according to the target temperature of the preceding sheet. For example, as shown in Table 15, in the case where the target temperature is "slightly low", "normal", or "slightly high", by performing the switching at "early timing", "timing at the middle between the preceding sheet and the subsequent sheet", and "slightly late timing" in the period between sheets, it is possible to control the fixing temperature minutely. Note that expressions such as "high", "low", "early", and "late" in the present modification are relative expressions, and are not intended to limit the target temperature and the switching timing. With regard to a relationship between the target temperature and the switching timing, a method in which a threshold value is set for the target temperature and the timing is switched stepwise may be used or a method which is based on a formula representing a function of the target temperature and the switching timing may also be used.

TABLE 15

| Target Temperature of Preceding Sheet | Switching Timing |
|---|---|
| Low | During Passage of Preceding Sheet (After Passage of Margin) |
| Slightly Low | Period Between Sheets (Early Timing) |
| Normal | Period Between Sheets (At Middle Between Timing of Passage of Preceding Sheet and Timing of Entry of Subsequent Sheet) |
| Slightly High | Period Between Sheets (Late Timing) |
| High | At Time of Entry of Subsequent Sheet |

As described thus far, according to the present invention, in the case where the difference in target temperature between the preceding sheet and the subsequent sheet is not less than a predetermined value, the switching timing of the target temperature from the target temperature of the preceding sheet to the target temperature of the subsequent sheet is changed according to the target temperature of the preceding sheet. As a result, it is possible to properly control timing at which the target temperature is switched according to the target temperatures of the preceding page and the subsequent page. For example, according to the present invention, it is possible to provide an image forming apparatus which has low power consumption while preventing a fixing failure without increasing a period between sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-159537, filed Sep. 29, 2021, which is hereby incorporated by reference wherein in its entirety.

What is claimed is:

1. An image forming apparatus comprising:

a fixing unit configured to heat a recording material on which a toner image based on image data is formed and which is transported at a fixing nip portion to fix the toner image to the recording material; and a control unit configured to determine a target temperature when the fixing unit heats the toner image for each recording material based on the image data, and control switching timing of the target temperature, wherein in a case where the target temperature of a first recording material is a first temperature, the target temperature of a second recording material which is fixed subsequently to the first recording material is a second temperature higher than the first temperature, and, a difference between the second temperature and the first temperature has a first value, the control unit starts switching to the second temperature from timing which is earlier than reaching of the second recording material to the fixing nip portion by a first period, in a case where the target temperature of a third recording material is a third temperature higher than the first temperature, the target temperature of a fourth recording material which is fixed subsequently to the third recording material is a fourth temperature higher than the third temperature, and, a difference between the fourth temperature and the third temperature has the first value, the control unit starts switching to the fourth temperature from timing which is earlier than reaching of the fourth recording material to the fixing nip portion by a second period, and the second period is shorter than the first period.

2. The image forming apparatus according to claim 1, wherein the control unit performs control such that the switching timing of the target temperature becomes timing after a portion of the first recording material on which the toner image is formed passes through the fixing nip portion.

3. The image forming apparatus according to claim 1, wherein the control unit performs control such that the switching timing of the target temperature becomes timing before or concurrent with timing at which a tip of the second recording material enters the fixing nip portion.

4. The image forming apparatus according to claim 1, wherein the control unit controls the switching timing of the target temperature in a case where the difference between the second temperature and the first temperature is not less than a predetermined temperature difference.

5. The image forming apparatus according to claim 1, wherein the control unit controls the switching timing of the target temperature stepwise according to the first temperature.

6. The image forming apparatus according to claim 1, wherein the control unit does not change a value of the switching timing of the target temperature from an initial value in a case where the second temperature is lower than the first temperature.

7. The image forming apparatus according to claim 6, wherein the initial value of the switching timing of the target temperature by the control unit is set in a period of inter-sheet processing which is a period from when a rear end of the first recording material passes through the fixing nip portion to when the second recording material enters the fixing nip portion.

* * * * *